US007106294B2

(12) United States Patent
Kumamoto et al.

(10) Patent No.: US 7,106,294 B2
(45) Date of Patent: Sep. 12, 2006

(54) LIQUID CRYSTAL DISPLAY DEVICE

(75) Inventors: Yasuhiro Kumamoto, Neyagawa (JP); Taro Funamoto, Mino (JP); Katsuyuki Arimoto, Okayama (JP)

(73) Assignee: Matsushita Electric Industrial Co., LTD, Osaka (JP)

( * ) Notice: Subject to any disclaimer, the term of this patent is extended or adjusted under 35 U.S.C. 154(b) by 292 days.

(21) Appl. No.: 10/487,281

(22) PCT Filed: Mar. 25, 2003

(86) PCT No.: PCT/JP03/03577

§ 371 (c)(1),
(2), (4) Date: Feb. 20, 2004

(87) PCT Pub. No.: WO03/083820

PCT Pub. Date: Oct. 9, 2003

(65) Prior Publication Data

US 2005/0007389 A1 Jan. 13, 2005

(30) Foreign Application Priority Data

Mar. 28, 2002 (JP) ..... 2002-091870

(51) Int. Cl.
*G09G 3/36* (2006.01)

(52) U.S. Cl. ..... 345/102; 345/87

(58) Field of Classification Search ..... 345/87–88, 345/102, 204, 208–214, 98–99; 349/61, 349/69–70

See application file for complete search history.

(56) References Cited

U.S. PATENT DOCUMENTS 5,844,540 A * 12/1998 Terasaki ..... 345/102
6,693,619 B1 * 2/2004 Miura et al. ..... 345/102
6,980,225 B1 * 12/2005 Funamoto et al. ..... 345/691
2002/0067332 A1 * 6/2002 Hirakata et al. ..... 345/102

FOREIGN PATENT DOCUMENTS

| | | |
|---|---|---|
| JP | 7-84254 | 3/1995 |
| JP | 9-96790 | 4/1997 |
| JP | 11-109921 | 4/1999 |
| JP | 2000-31790 | 1/2000 |
| JP | 2000-293142 | 10/2000 |
| JP | 2000-321551 | 11/2000 |
| JP | 2003-50569 | 2/2003 |

* cited by examiner

*Primary Examiner*—Richard Hjerpe
*Assistant Examiner*—Mansour M. Said
(74) *Attorney, Agent, or Firm*—Wenderoth, Lind & Ponack, L.L.P.

(57) ABSTRACT

A doubler part doubles frequencies of video signals. A drive control circuit generates, in response to a synchronizing signal outputted from the doubler part, PWM dimming frequency information such that a PWM dimming frequency f and a black display ratio B satisfy the relationships $f \geqq 25B+250$ and $B>10$, and provides such information to a PWM dimming signal generation circuit. In addition, the drive control circuit drives a gate driver and a source driver such that one frame period is divided into an image display period and a black display period. The PWM dimming signal generation circuit generates, in response to a synchronizing signal and the PWM dimming frequency information, a PWM dimming signal and provides the PWM dimming signal to a lighting circuit. The lighting circuit activates a backlight device with dimming, in response to the PWM dimming signal. This configuration reduces colored interference fringes in a liquid crystal display device resulting from the combination of a black insertion drive technique and a PWM dimming technique.

12 Claims, 20 Drawing Sheets

LIQUID CRYSTAL DISPLAY DEVICE

TECHNICAL FIELD

The present invention relates to a liquid crystal display, and more particularly to a liquid crystal display device that displays images by irradiating a liquid crystal panel, which is driven in response to video signals, with light outputted from a backlight.

BACKGROUND ART

Liquid crystal display devices are so-called hold-type image display devices in which the signal level is held, as shown in FIG. 17, for one frame period in each liquid crystal cell. For the types of liquid crystals used in liquid crystal display devices, conventionally, a TN (Twisted Nematic) mode liquid crystal is commonly used, but in recent years, in order to overcome the drawbacks of the TN-mode liquid crystal (e.g., a narrow viewing angle and a slow response time), liquid crystal display devices using an OCB (Optically Self-Compensated Birefringence) mode liquid crystal have been studied. Such devices are disclosed, for example, in Japanese Laid-Open Patent Publication Nos. 7-84254 and 9-96790. As is disclosed in Japanese Laid-Open Patent Publication No. 9-96790, the OCB mode requires some kind of initialization process in which the state of a liquid crystal cell is changed (hereinafter referred to as a "transition") from a splay alignment to a bend alignment by application of a high voltage (which would result in a black display in the case of normally-white). However, after the initialization process, once the applied voltage to the liquid crystal becomes less than a predetermined value Va, the state of the liquid crystal cell returns to the splay alignment (hereinafter referred to as a reverse transition). For this reason, the OCB mode can be used only in an applied voltage range (Va to Vblack) which allows the bend alignment to be maintained, such as the one shown by the curve a in FIG. 18.

It has been found, however, that even if a period exists in which the applied voltage to the liquid crystal temporarily becomes less than the predetermined value Va, if a high voltage is periodically applied in periods other than the aforementioned period, a reverse transition does not occur. For example, in a liquid crystal display device disclosed in Japanese Laid-Open Patent Publication No. 2000-31790, the frequencies of video signals are doubled, each gate line is selected twice in each frame period, and a video signal and a signal for applying the aforementioned high voltage are written alternately to each pixel of the liquid crystal panel (each signal is written once in one frame period). This makes it possible to use a wider applied voltage range, such as the one shown by the curve b in FIG. 18. It is known that the minimum high-voltage application period that ensures elimination of reverse transition (hereinafter referred to as black display period) is a period which is about 10% of one frame period.

Meanwhile, as for improvement in the response time of liquid crystal, it has been reported that in the TN-mode liquid crystal, by reducing the cell gap from about 5 μm, which is conventionally employed, to about 2 μm, the response time of a liquid crystal can be made shorter than one frame period (16.6 ms).

By employing the black insertion drive technique in a liquid crystal panel with a fast response time, such as a liquid crystal panel using the aforementioned OCB-mode liquid crystal or a liquid crystal panel using a TN-mode liquid crystal in which the cell gap is reduced to about 2 μm, the edge blurring when displaying a moving image is expected to be greatly reduced.

As a method of controlling the luminance of a backlight of a liquid crystal display device, conventionally, a voltage dimming technique and a PWM (Pulse Width) dimming technique are widely employed. The voltage dimming technique controls luminance by changing the applied voltage to a fluorescent lamp, which serves as a backlight source. The PMW dimming technique controls luminance in a manner such that, as shown in FIG. 19, dimming is performed in response to a PWM dimming signal having a periodic rectangular waveform. The lamp current is allowed to flow only during an ON period (pulse width) of the signal.

The voltage dimming technique, though its circuit configuration is simple, has drawbacks. For example, when the drive voltage is low, proper lighting of the fluorescent lamp is difficult to obtain. On the other hand, in the PWM dimming technique, though the luminance of the fluorescent lamp can be easily controlled, there is a drawback in that switching noise occurs at the time of dimming. When controlling the lighting of the backlight by the PWM dimming technique, if the dimming frequency is increased, the luminance efficiency is greatly reduced due to switching losses, etc., and therefore the dimming frequency is typically set to 300 Hz or less.

Meanwhile, it has been confirmed by an observation performed by the inventors that when backlight control by the PWM dimming technique and the aforementioned black insertion drive technique are simultaneously performed, color non-uniformity, as shown in FIG. 20, such that a properly displayed portion c and a luminance-reduction portion d accompanied with coloring are displayed alternately, occurs in an entire-screen white display state. The cause of this color non-uniformity is briefly described below.

The content to be displayed on the liquid crystal display device is defined by the product of the amount of light emitted from the backlight multiplied by the transmittance of the liquid crystal panel, and in practice, the time-average value of this product is perceived by the viewer's eye. In the aforementioned properly displayed portion c in FIG. 20, an operation such as that shown in FIG. 21 is performed. That is, the light-off period of the backlight in PWM dimming coincides with the black display period of the liquid crystal panel, and therefore the actual display content is hardly adversely affected and a reduction in luminance hardly occurs. (In practice, light is emitted even during the light-off period due to the persistence characteristics of phosphors, and thus a slight reduction in luminance is caused.)

On the other hand, in the colored luminance-reduction portion din FIG. 20, an operation such as that shown in FIG. 22 is performed. That is, the light-on period in PWM dimming coincides with the black display period of the liquid crystal panel, and therefore a reduction in luminance is caused in the actual display content. For phosphors which are generally widely used in liquid crystal display devices, $Y_2O_3:Eu^{3+}$ is used as a red-emitting phosphor, $LaPO_4:Tb^{3+}$ is used as a green-emitting phosphor, and $BaMgAl_{10}O_{17}:Eu^{2+}$ is used as a blue-emitting phosphor. The 1/10 persistence time of the red, green, and blue emitting phosphors are about 3 ms, about 8 ms, and about 0.1 ms or less, respectively. As can be seen, in the persistence components of the backlight there are great differences in the persistence time between the phosphors, and thus coloring occurs in the colored luminance-reduction portion d.

Accordingly, an object of the present invention is to reduce colored interference fringes in a liquid crystal display device resulting from the combination of the black insertion drive technique and the PWM dimming technique.

SUMMARY OF THE INVENTION

To achieve the above object, the present invention has the following aspect. It is to be understood that reference numerals, etc., in parentheses are provided, for the purpose of helping to understand the present invention, to show the corresponding relationship with embodiments, as will be described later, and thus are not intended to limit the scope of the present invention.

A liquid crystal display device of the present invention displays images by irradiating a liquid crystal panel (11), which is driven in response to video signals, with light outputted from a backlight device (15). The liquid crystal display device comprises: drive means (10 and 14) for driving the liquid crystal panel in response to the video signals in a manner such that one frame period is divided into a black display period and an image display period; a PWM dimming signal generation circuit (17) for generating a PWM dimming signal for controlling the backlight device by a PWM dimming technique; a lighting circuit (16) for driving the backlight device in response to the PWM dimming signal; and means (18, 28, 34, and 53) for controlling a cycle and/or phase of the PWM dimming signal to prevent occurrence of interference fringes in the liquid crystal panel, caused by the PWM dimming technique.

BEST MODE FOR CARRYING OUT THE INVENTION

With reference to the drawings, various embodiments of the present invention are described below.

(Embodiment 1)

Figure 1:
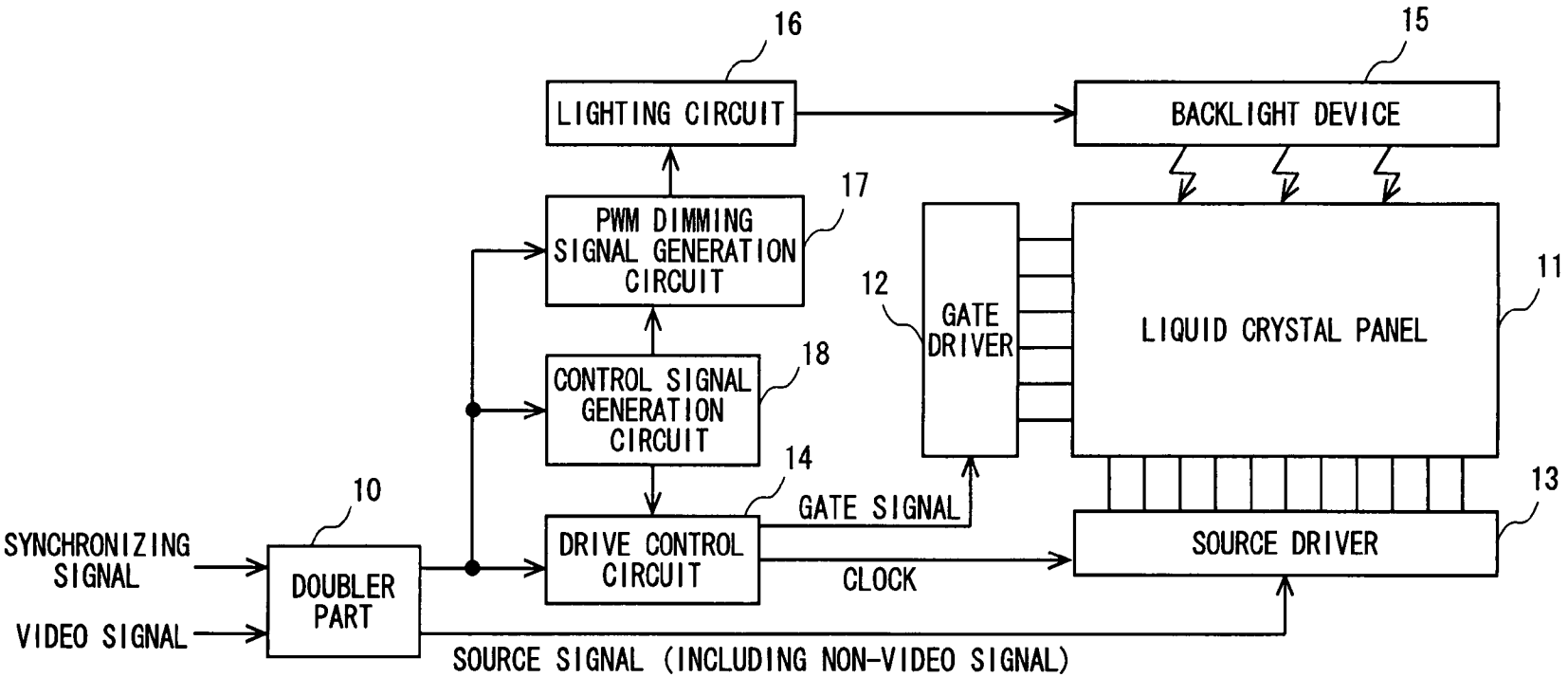
FIG. 1 is a block diagram showing the configuration of a liquid crystal display device according to Embodiment 1 of the present invention.

FIG. 1 is a block diagram showing the configuration of a liquid crystal display device according to Embodiment 1 of the present invention. The liquid crystal display device includes a doubler part 10, a liquid crystal panel 11, a gate driver 12, a source driver 13, a drive control circuit 14, a backlight device 15, a lighting circuit 16, a PWM dimming signal generation circuit 17, and a control signal generation circuit 18.

Figure 2:
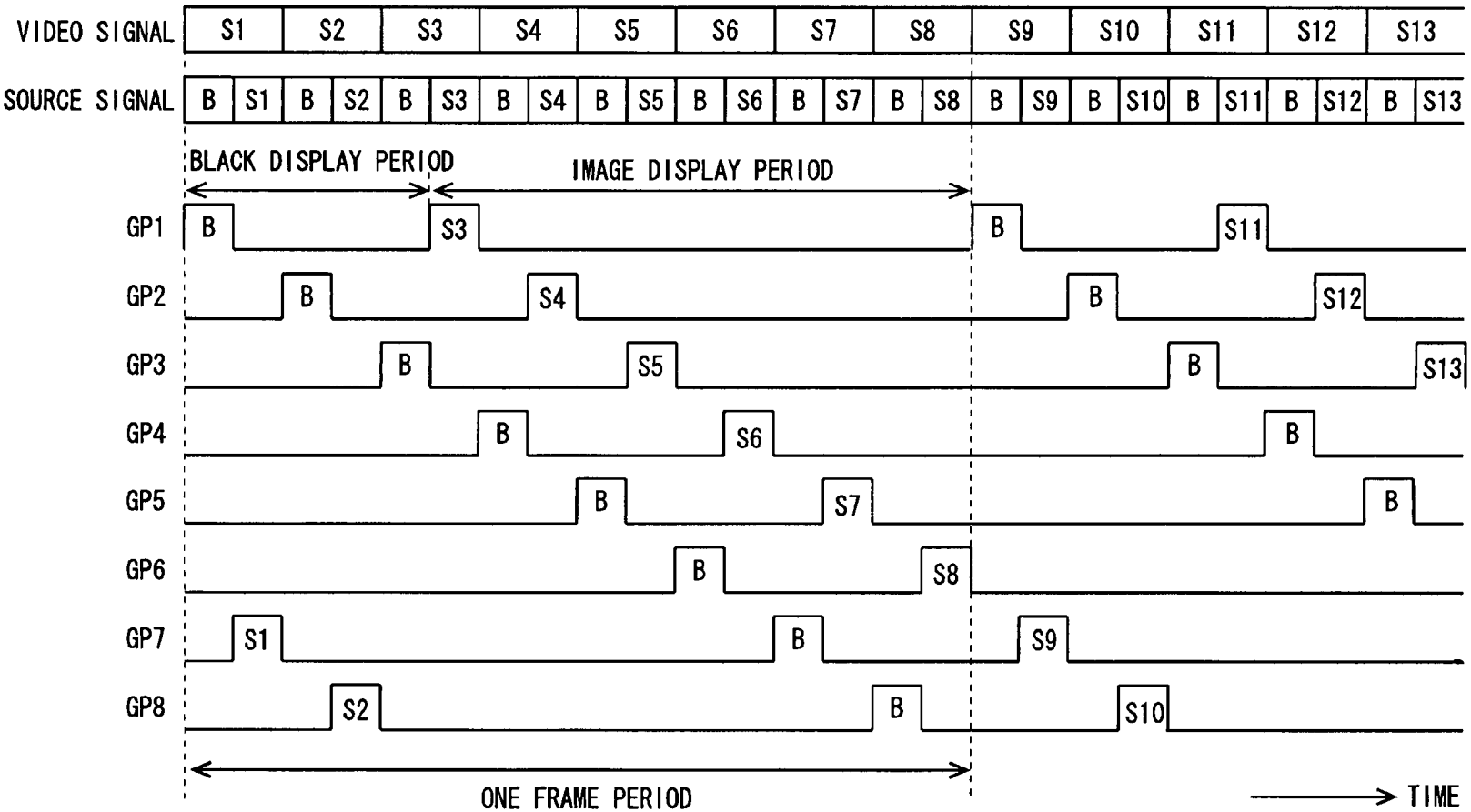
FIG. 2 is a diagram showing the relationship between the operation of a doubler part and a black display period and an image display period.

To the liquid crystal display device are fed video signals and a synchronizing signal. The doubler part 10 doubles the frequencies of the video signals in response to the video and synchronizing signals. Then, the doubler part 10 provides a source signal to the source driver 13 and also provides the frequency-doubled synchronizing signal to the drive control circuit 14, the control signal generation circuit 18, and the PWM dimming signal generation circuit 17. Here, as the source signal, as shown in FIG. 2, original video signals (S1, S2, S3, . . . ) and non-video signals (B) are outputted alternately. The non-video signal serves to apply a high voltage to the liquid crystal panel 11, and corresponds to a black display.

The control signal generation circuit 18 receives the synchronizing signal outputted from the doubler part 10, generates black display period information such that the black display period is an integral multiple of a PWM dimming cycle and PWM dimming cycle information, and then provides them to the drive control circuit 14 and the PWM dimming signal generation circuit 17, respectively. The drive control circuit 14 outputs a clock for driving the source driver 13 and a gate signal for driving the gate driver 12, in response to the aforementioned black display period information and frequency-doubled synchronizing signal outputted from the doubler part 10. The gate driver 12 outputs, in response to the gate signal, gate pulses (GP1 to GP8), such as those shown in FIG. 2, to gate lines of the liquid crystal panel 11, respectively. For simplicity of description, FIG. 2 shows the case where eight gate lines are present. To pixels of each gate line of the liquid crystal panel 11, a non-video signal and a video signal are each written once in one frame period. In the description below, the period of time from when a non-video signal is written until a video signal is written is referred to as a black display period, and the period of time from when a video signal is written until a non-video signal is written is referred to as an image display period.

The PWM dimming signal generation circuit 17 generates a PWM dimming signal in response to the synchronizing signal and the aforementioned PWM dimming cycle information, and provides the PWM dimming signal to the lighting circuit 16. The lighting circuit 16 activates the backlight device 15 with dimming, in response to the PWM dimming signal.

Figure 3:
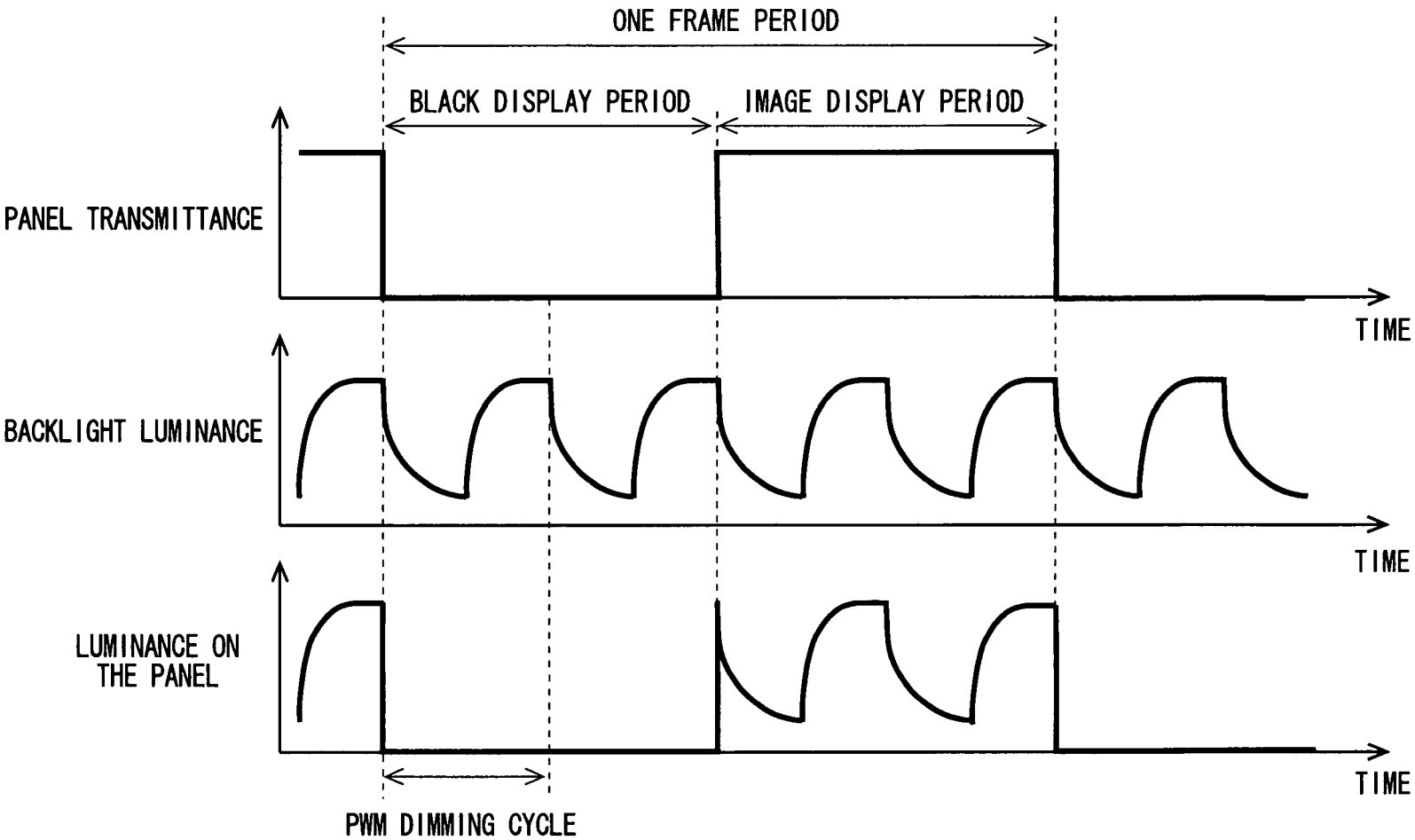
FIG. 3 is a diagram showing the operation of Embodiment 1.

With reference to FIG. 3, the operation of the present embodiment is described in detail below.

In the present embodiment, by the control signal generation circuit 18, the black display period is set to be an integral multiple (double in the example in FIG. 3) of the PWM dimming cycle in the backlight, as shown in FIG. 3. Accordingly, light emitted from the backlight device 15 is shielded during the black display period for a period equal to an integral multiple of the PWM dimming cycle. Thus, the time-average value of the ratio of the amount of backlight light and persistence components shielded in the black display period becomes more uniform across the entire screen, thereby reducing non-uniformity of luminance and color.

For the liquid crystal panel 11, it is preferable to use either an OCB-mode liquid crystal panel or an TN-mode liquid crystal panel with a cell gap of less than 5 μm (preferably about 2 μm), because in such panels the response time of liquid crystal is fast, and accordingly, edge blurring of a moving image can be further reduced.

In the present embodiment, the black display period is set to be an integral multiple of the PWM dimming cycle. However, needless to say, even if it is not exactly an integral multiple, as long as the black display period is set to have the relationship close thereto, substantially the same effects are achieved. For example, if the black display period satisfies the following relationship:

$$\text{Black display period}=(\text{integer})\cdot(\text{PWM dimming cycle})\pm 0.3\cdot(\text{PWM dimming cycle}),$$

favorable effects are achieved.

As described above, according to the present embodiment, since the black display period is set to be an integral multiple of the PWM dimming cycle, it is possible to reduce colored interference fringes in a liquid crystal display device resulting from the combination of the black insertion drive technique and the PWM dimming technique.

(Embodiment 2)

Figure 4:
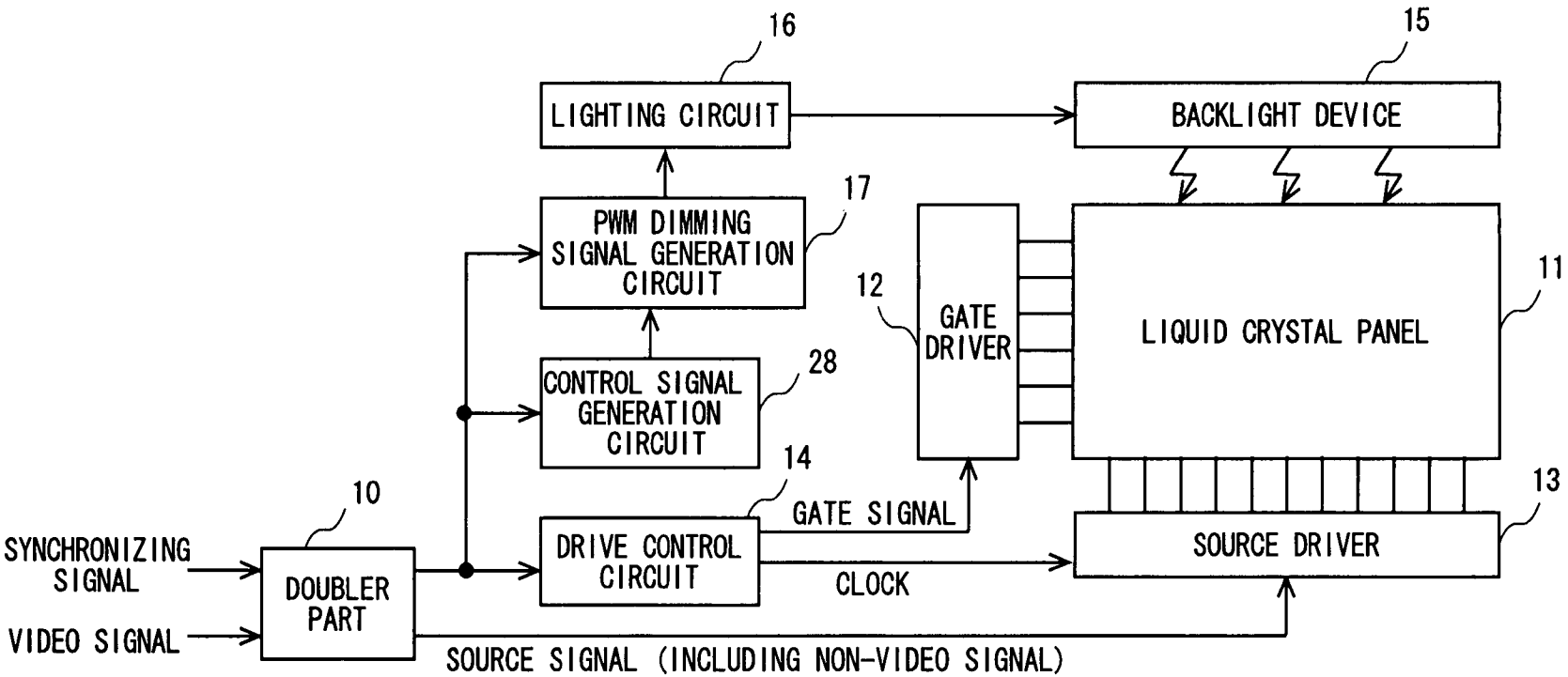
FIG. 4 is a block diagram showing the configuration of a liquid crystal display device according to Embodiment 2 of the present invention.

FIG. 4 is a block diagram showing the configuration of a liquid crystal display device according to Embodiment 2 of the present invention. The liquid crystal display device includes a doubler part 10, a liquid crystal panel 11, a gate driver 12, a source driver 13, a drive control circuit 14, a backlight device 15, a lighting circuit 16, a PWM dimming signal generation circuit 17, and a control signal generation circuit 28. In FIG. 4, the elements corresponding to those found in FIG. 1 are designated by like reference numerals and the descriptions thereof are omitted.

The control signal generation circuit 28 receives a synchronizing signal outputted from the doubler part 10, generates PWM dimming frequency information such that the PWM dimming frequency is (an odd number/2) times the vertical frequency, and then provides such information to the PWM dimming signal generation circuit 17.

Figure 5:
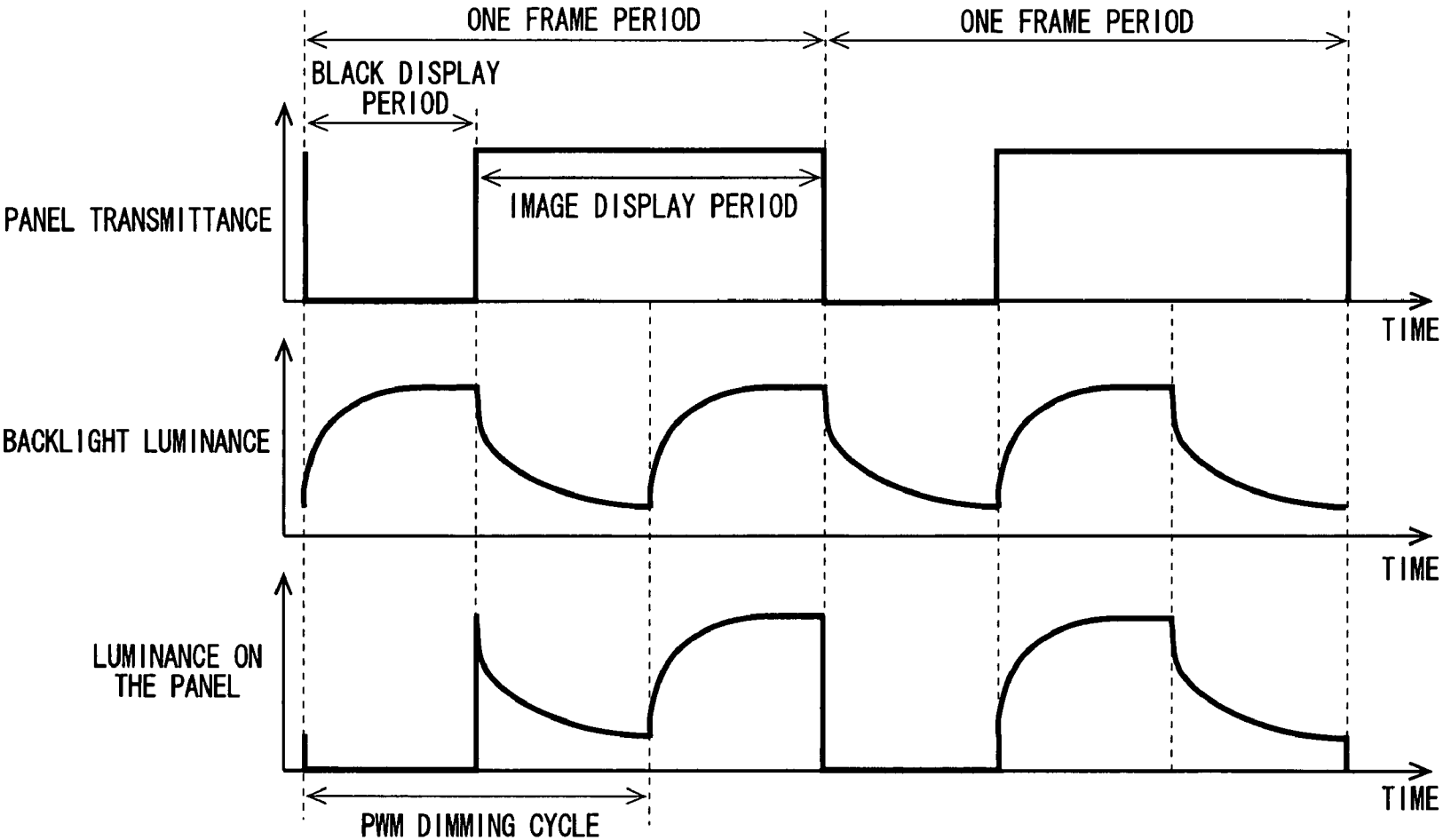
FIG. 5 is a diagram showing the operation of Embodiment 2.

With reference to FIG. 5, the operation of the present embodiment is described in detail below.

In the present embodiment, by the control signal generation circuit 28, the PWM dimming frequency is set to be (an odd number/2) times the vertical frequency, as shown in FIG. 5. This indicates a state in which the backlight device 15 is activated in a manner similar to an interleaved mode. The waveform of the backlight luminance, which has been dimmed by the PWM dimming technique, has a shape such that a lighting-delayed part in a light-on period and persistence characteristics in a light-off period are substantially inverted with respect to each other. Thus, by setting the PWM dimming frequency to be (an odd number/2) times the vertical frequency, the light-on period and light-off period of the backlight alternately correspond, frame by frame, to the black display period. Accordingly, the time-average value of the ratio of the amount of backlight light and persistence components shielded in the black display period becomes more uniform across the entire screen, thereby reducing non-uniformity of luminance and color.

For the liquid crystal panel 11, it is preferable to use either an OCB-mode liquid crystal panel or an TN-mode liquid crystal panel with a cell gap of less than 5 μm (preferably about 2 μm), because in such panels the response time of liquid crystal is fast, and accordingly, edge blurring of a moving image can be further reduced.

In the present embodiment, the PWM dimming frequency is set to be (an odd number/2) times the vertical frequency but, needless to say, even if it is not exactly (an odd number/2) times, as long as the PWM dimming frequency and the vertical frequency have the relationship close thereto, substantially the same effects are achieved. For example, if the PWM dimming frequency satisfies the following relationship:

$$\text{PWM dimming frequency}=(\text{an odd number}/2)\cdot(\text{vertical frequency})\pm 0.2\cdot(\text{vertical frequency}),$$

favorable effects are achieved.

As is described above, according to the present embodiment, since the PWM dimming frequency is set to be (an odd number/2) times the vertical frequency, it is possible to reduce colored interference fringes in a liquid crystal display device resulting from the combination of the black insertion drive technique and the PWM dimming technique.

(Embodiment 3)

Figure 6:
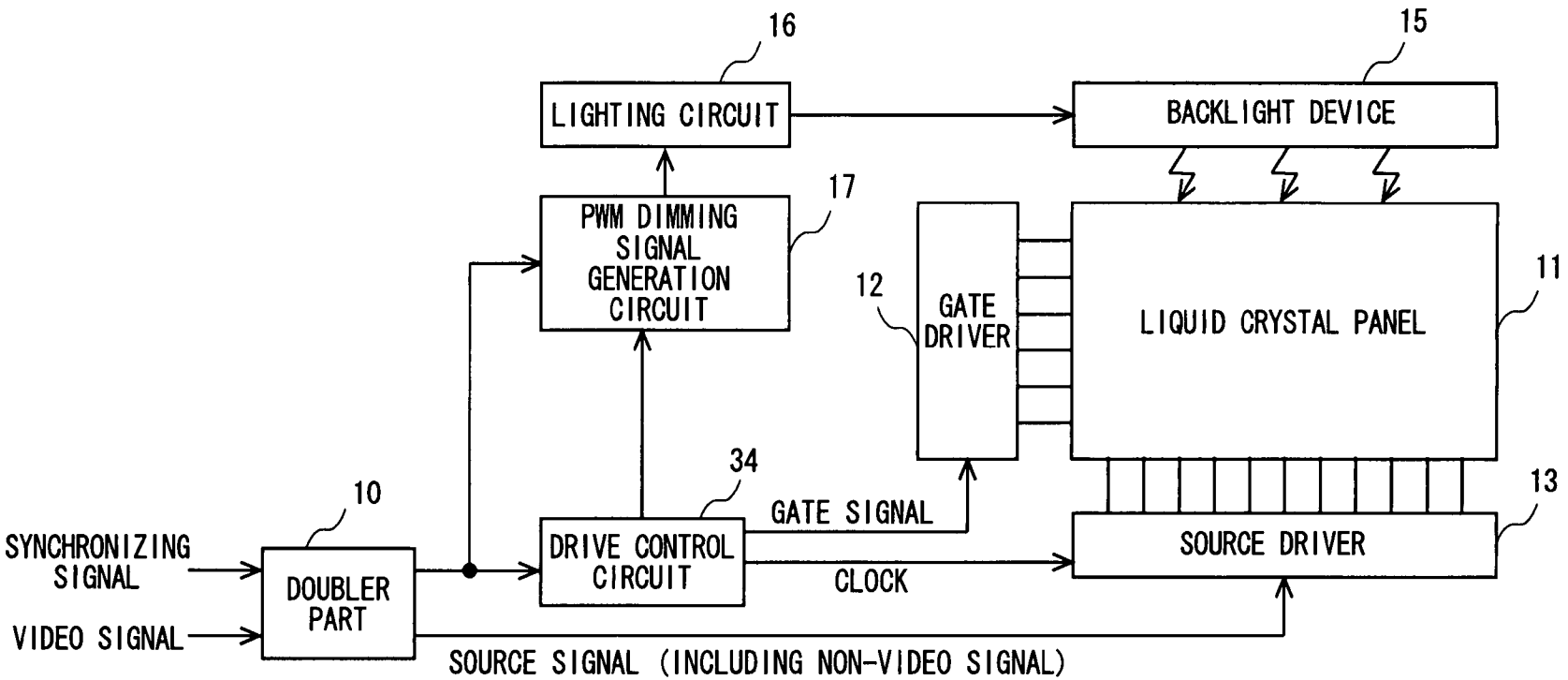
FIG. 6 is a block diagram showing the configuration of a liquid crystal display device according to Embodiment 3 of the present invention.

FIG. 6 is a block diagram showing the configuration of a liquid crystal display device according to Embodiment 3 of the present invention. The liquid crystal display device includes a doubler part 10, a liquid crystal panel 11, a gate driver 12, a source driver 13, a drive control circuit 34, a backlight device 15, a lighting circuit 16, and a PWM dimming signal generation circuit 17. In FIG. 6, the elements corresponding to those found in FIG. 1 are designated by like reference numerals and the descriptions thereof are omitted.

The drive control circuit 34 generates, in response to a synchronizing signal outputted from the doubler part 10, PWM dimming frequency information such that a PWM dimming frequency f and a black display ratio B satisfy the relationships $f \geqq 25B+250$ and $B>10$, and provides such information PWM dimming signal generation circuit 17.

Figure 7:
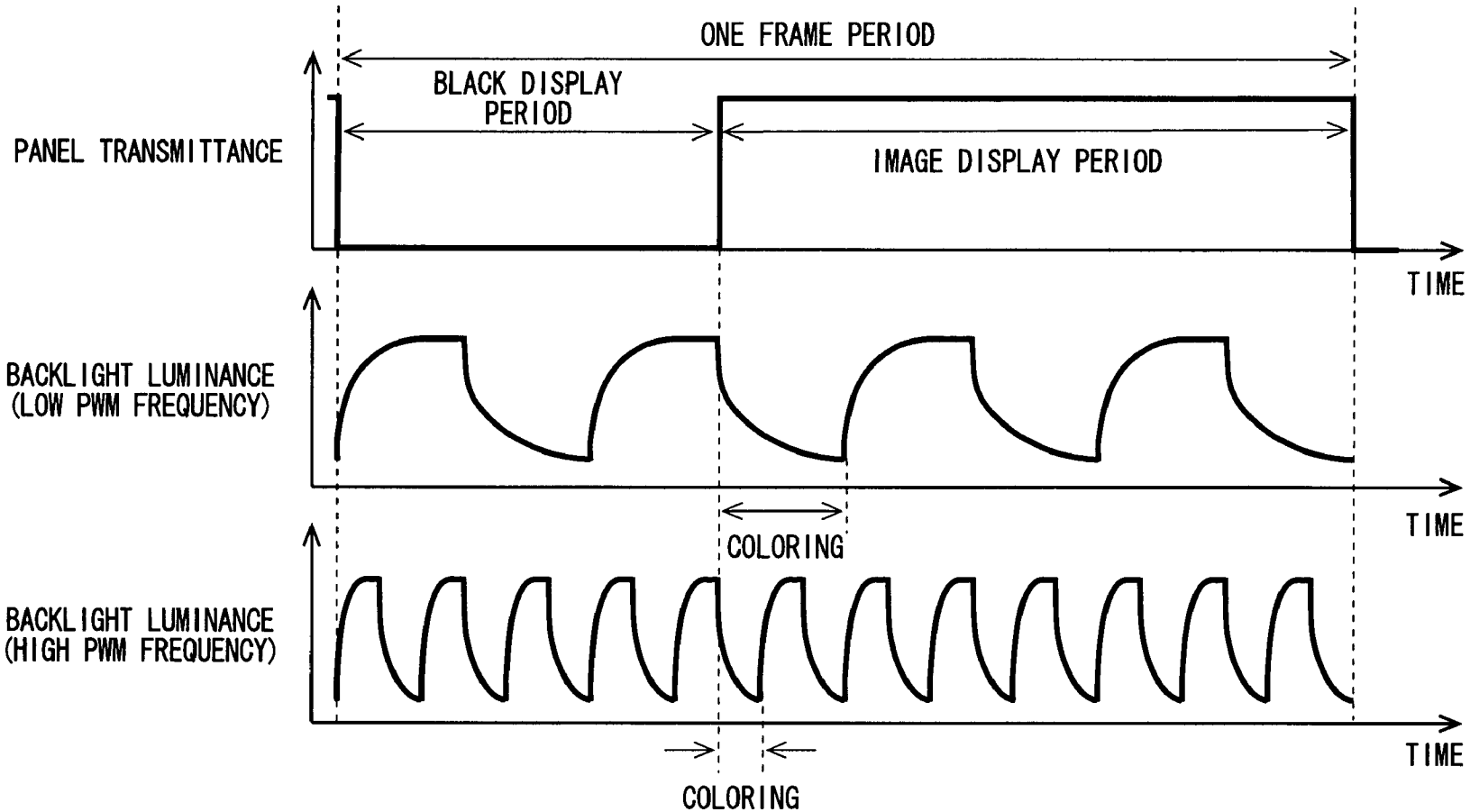
FIG. 7 is an illustrative diagram illustrating the principle where the degree of color non-uniformity changes with PWM dimming frequencies.

With reference to FIG. 7, the principle of the present embodiment is described below.

Figure 8:
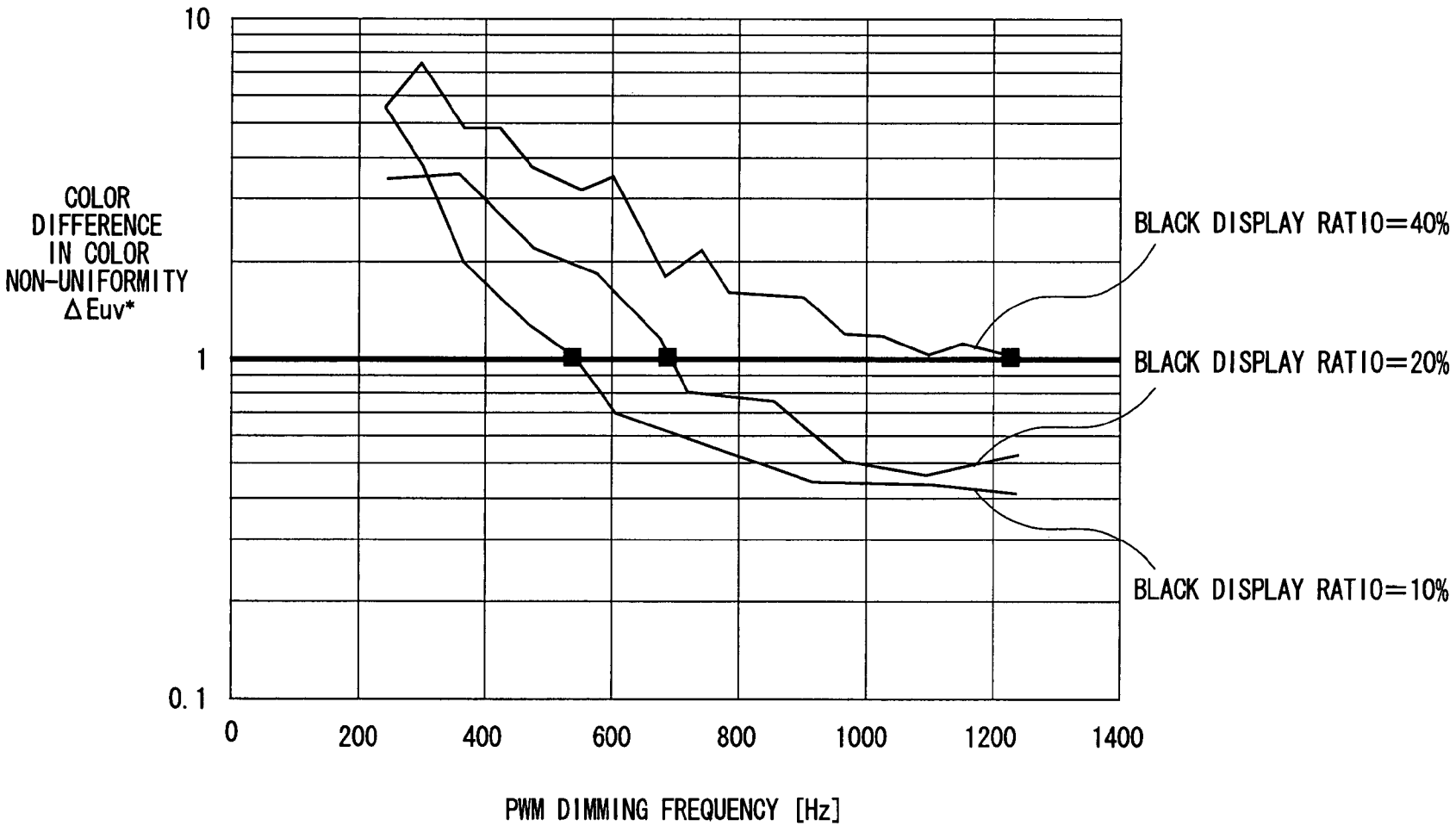
FIG. 8 is a diagram showing the relationship between the PWM dimming frequency and the color difference in color non-uniformity for different black display ratios.
Figure 9:
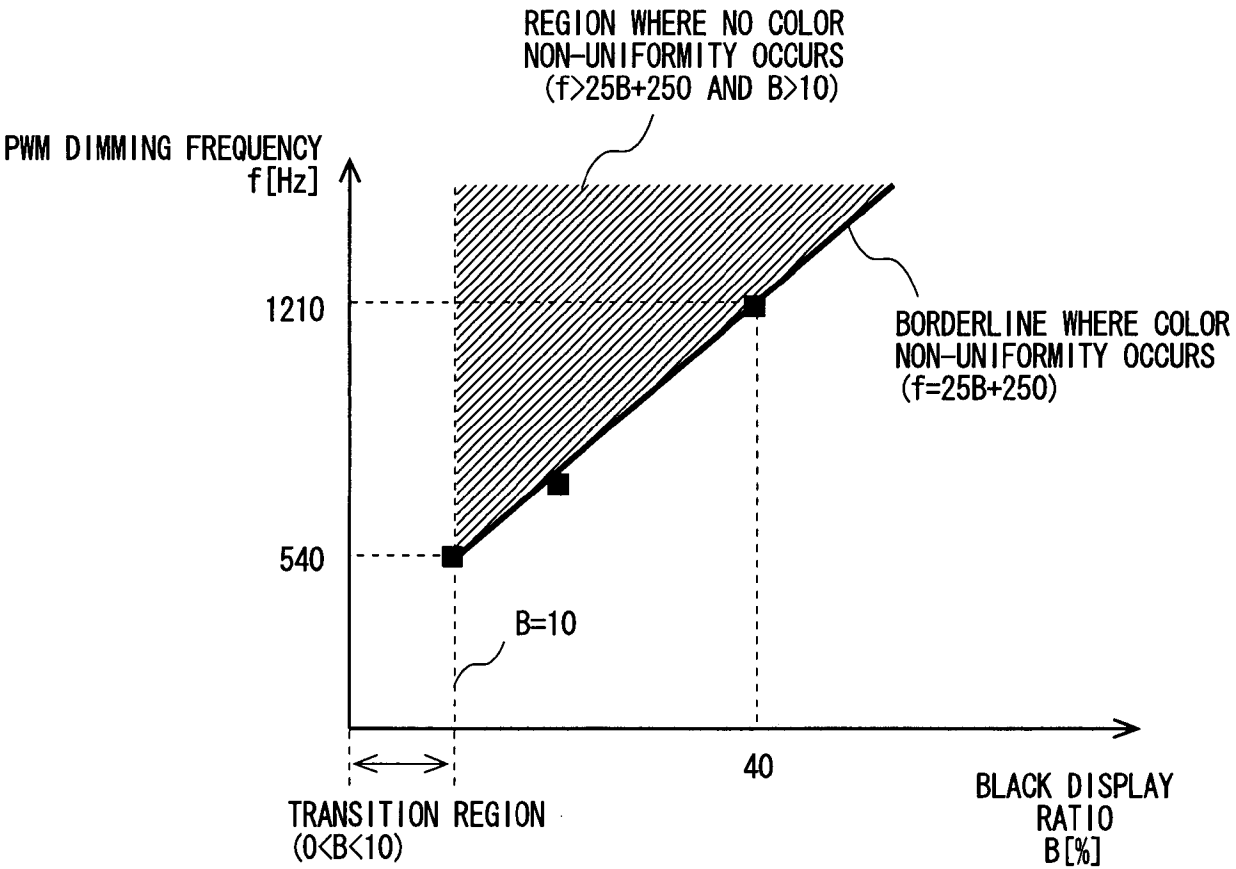
FIG. 9 is a diagram showing conditions that a black display ratio and a PWM dimming frequency should satisfy to prevent occurrence of color non-uniformity.

The relationship between the PWM dimming frequency and the degree of coloring is, as shown in FIG. 7, such that the lower the PWM dimming frequency, the higher the degree of coloring. The present inventors have examined the relationship between the PWM dimming frequency of the backlight and the color difference in chromaticity variation in a liquid crystal display device using an OCB-mode liquid crystal. FIG. 8 is a diagram showing the relationship between the PWM dimming frequency and the color difference in color non-uniformity ΔEuv* (color difference in CIE 1976 L*u*v* color space) for various ratios of black display period to one frame period (hereinafter referred to as black display ratios). It can be seen that there is a tendency that as the black display ratio decreases, the color difference ΔEuv* decreases, and as the PWM dimming frequency increases, the color difference ΔEuv* decreases. The minimum color difference that the human can perceive is generally said to be ΔEuv* =1 (see, for example, Noboru Ohta, "Basics of Color Reproduction Optics (Iro Saigen Kogaku No Kiso)," Corona Publishing Co., Ltd., p.46). When the PWM dimming frequency f (Hz), at which the color difference ΔEuv* =1, is plotted from data of each of the black display ratios B (%), the plotted values are distributed around the line f=25B+250, as shown in FIG. 9. If the borderline where color non-uniformity occurs is defined by the line f=25B+250, the region where no color non-uniformity occurs is such a region that satisfies the condition f25B+250. It is to be noted, however, that as is described above, in the case of performing a black insertion drive in an OCB-mode liquid crystal, the black display ratio B (%) needs to be such that B>10. Otherwise, a reverse transition occurs and normal functions are impaired, and therefore, the region where no color non-uniformity occurs in an OCB-mode liquid crystal is such a region that satisfies the conditions f25B+250 and B>10, such as the shaded area in FIG. 9.

For the liquid crystal panel 11, it is preferable to use either an OCB-mode liquid crystal panel or an TN-mode liquid crystal panel with a cell gap of less than 5 μm (preferably about 2 μm), because in such panels the response time of liquid crystal is fast, and accordingly, edge blurring of a moving image can be further reduced.

In the present embodiment, the PWM dimming frequency f and the black display ratio B are set to satisfy the relationships f ≧25B+250 and B>10, but the condition B>10 is specific to an OCB-mode liquid crystal and thus is not essential in the case of using other liquid crystals.

As is described above, according to the present embodiment, since the PWM dimming frequency f and the black display ratio B are set to satisfy the relationship f ≧25B+250, it is possible to reduce non-uniformity of luminance and color in a liquid crystal display device resulting from the combination of the black insertion drive technique and the PWM dimming technique.

(Embodiment 4)

Figure 10:
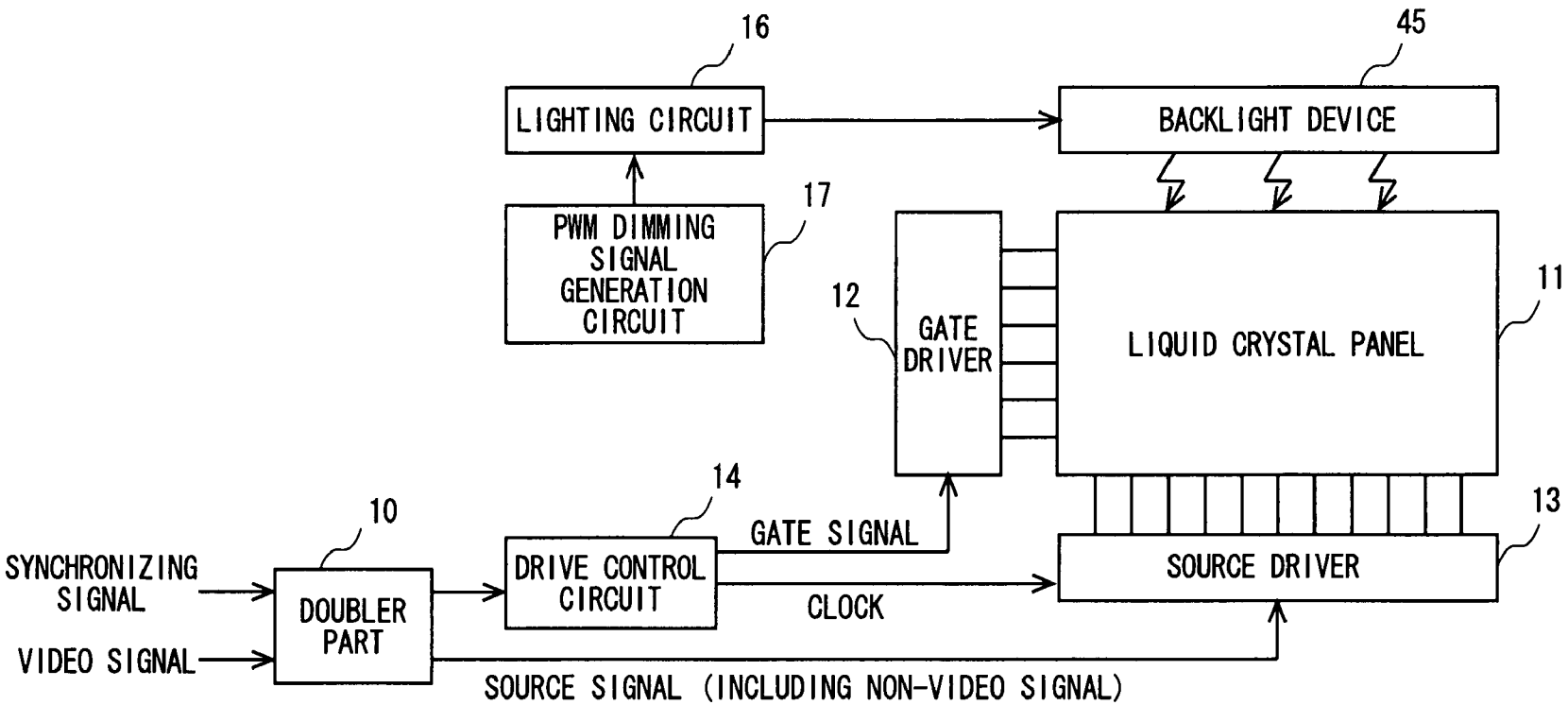
FIG. 10 is a block diagram showing the configuration of a liquid crystal display device according to Embodiment 4 of the present invention.

FIG. 10 is a block diagram showing the configuration of a liquid crystal display device according to Embodiment 4 of the present invention. The liquid crystal display device includes a liquid crystal panel 11, a doubler part 10, a gate driver 12, a source driver 13, a drive control circuit 14, a backlight device 45, a lighting circuit 16, and a PWM dimming signal generation circuit 17. In FIG. 10, the elements corresponding to those found in FIG. 1 are designated by like reference numerals and the descriptions thereof are omitted.

In a fluorescent lamp of the backlight device 45, phosphors are used in which the 1/10 persistence time is 40 ms or greater.

The drive control circuit 14 drives, in response to a synchronizing signal outputted from the doubler part 10, the gate driver 12 and the source driver 13 in a manner such that one frame period is divided into an image display period and a black display period. The PWM dimming signal generation circuit 17 provides a PWM dimming signal to the lighting circuit 16. The lighting circuit 16 activates the backlight device 45 with dimming, in response to the PWM dimming signal.

Figure 11A:
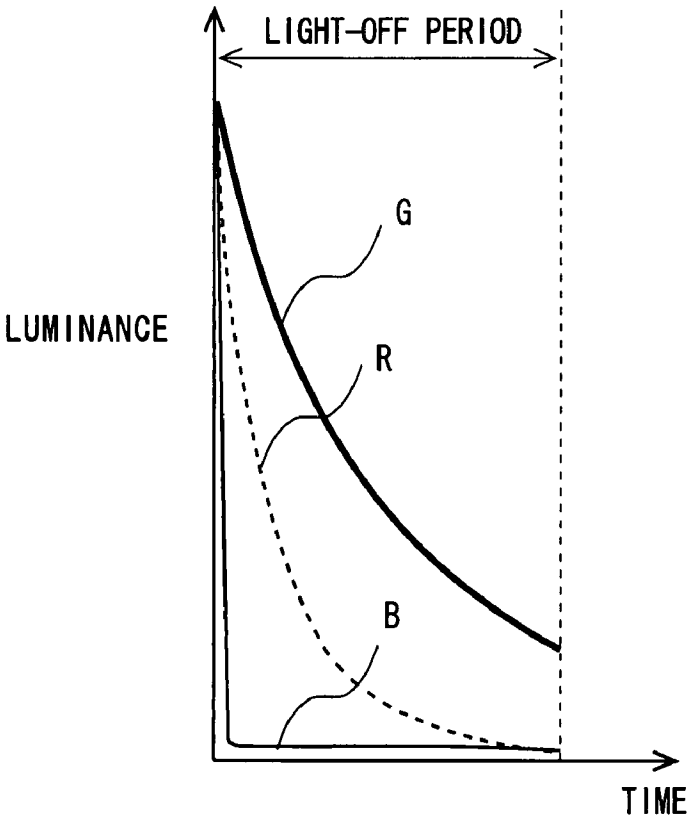
FIGS. 11(*a*) and 11(*b*) are illustrative diagrams showing the relationship between 1/10 persistence time and color non-uniformity.
Figure 11B:
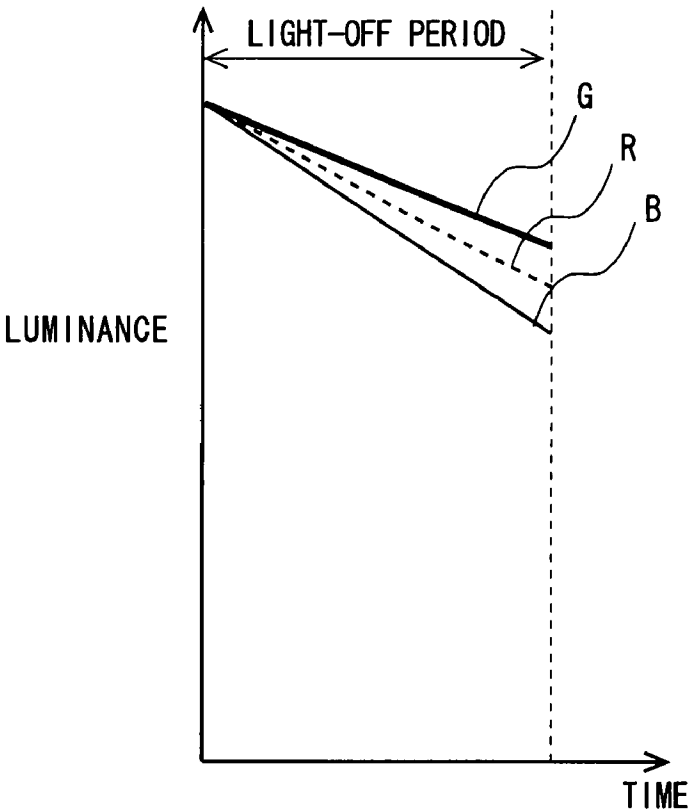

In the present invention, in the fluorescent lamp of the backlight device 45, phosphors are used in which the 1/10 persistence time is 40 ms or greater. With reference to FIGS. 11(*a*) and 11(*b*), the effects thereof are described below. FIGS. 11(*a*) and 11(*b*) are diagrams showing the persistence components of the backlight device in a light-off period for various phosphors. FIG. 11(*a*) shows the case of using phosphors which are typically used in liquid crystal display devices and have a 1/10 persistence time of about 8 ms, and FIG. 11(*b*) shows the case of using phosphors having a 1/10 persistence time of 40 ms or greater. As is clear by comparing FIGS. 11(*a*) and 11(*b*), in the case of using phosphors having a 1/10 persistence time of 40 ms or greater, the persistence time of the backlight is sufficiently long compared to the PWM dimming cycle and thus the off-balance of the persistence components between RGB is small. Accordingly, non-uniformity of luminance and color can be reduced.

For the liquid crystal panel 11, it is preferable to use either an OCB-mode liquid crystal panel or an TN-mode liquid crystal panel with a cell gap of less than 5 μm (preferably about 2 μm), because in such panels the response time of liquid crystal is fast, and accordingly, edge blurring of a moving image can be further reduced.

In the present embodiment, in a fluorescent lamp of the backlight device 45, phosphors are used in which the 1/10 persistence time is 40 ms or greater, but needless to say, even with phosphors in which the 1/10 persistence time is close to 40 ms, substantially the same effects are achieved.

As is described above, according to the present embodiment, since phosphors in which the 1/10 persistence time is 40 ms or greater are used in a fluorescent lamp of the backlight device 45, it is possible to reduce colored interference fringes in a liquid crystal display device resulting from the combination of the black insertion drive technique and the PWM dimming technique.

(Embodiment 5)

Figure 12:
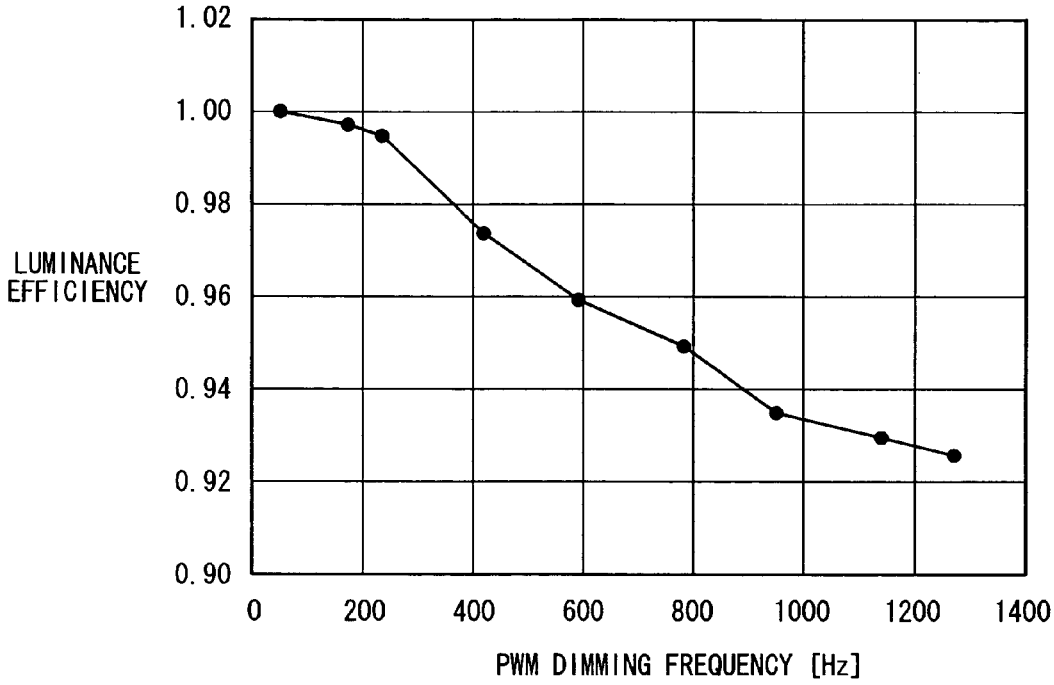
FIG. 12 is a diagram showing luminance efficiency versus PWM dimming frequency.

In the foregoing Embodiment 3, color fringes are reduced through driving with a PWM dimming frequency which is sufficiently high compared to that of conventional ones, by relying on the black insertion ratio. However, when the PWM dimming frequency is increased, switching loss tends to occur more frequently, which in turn reduces luminance efficiency, as shown in FIG. 12. In Embodiment 5, a liquid crystal display device is described with which color fringes can be reduced without the need to increase the PWM dimming frequency.

Figure 13:
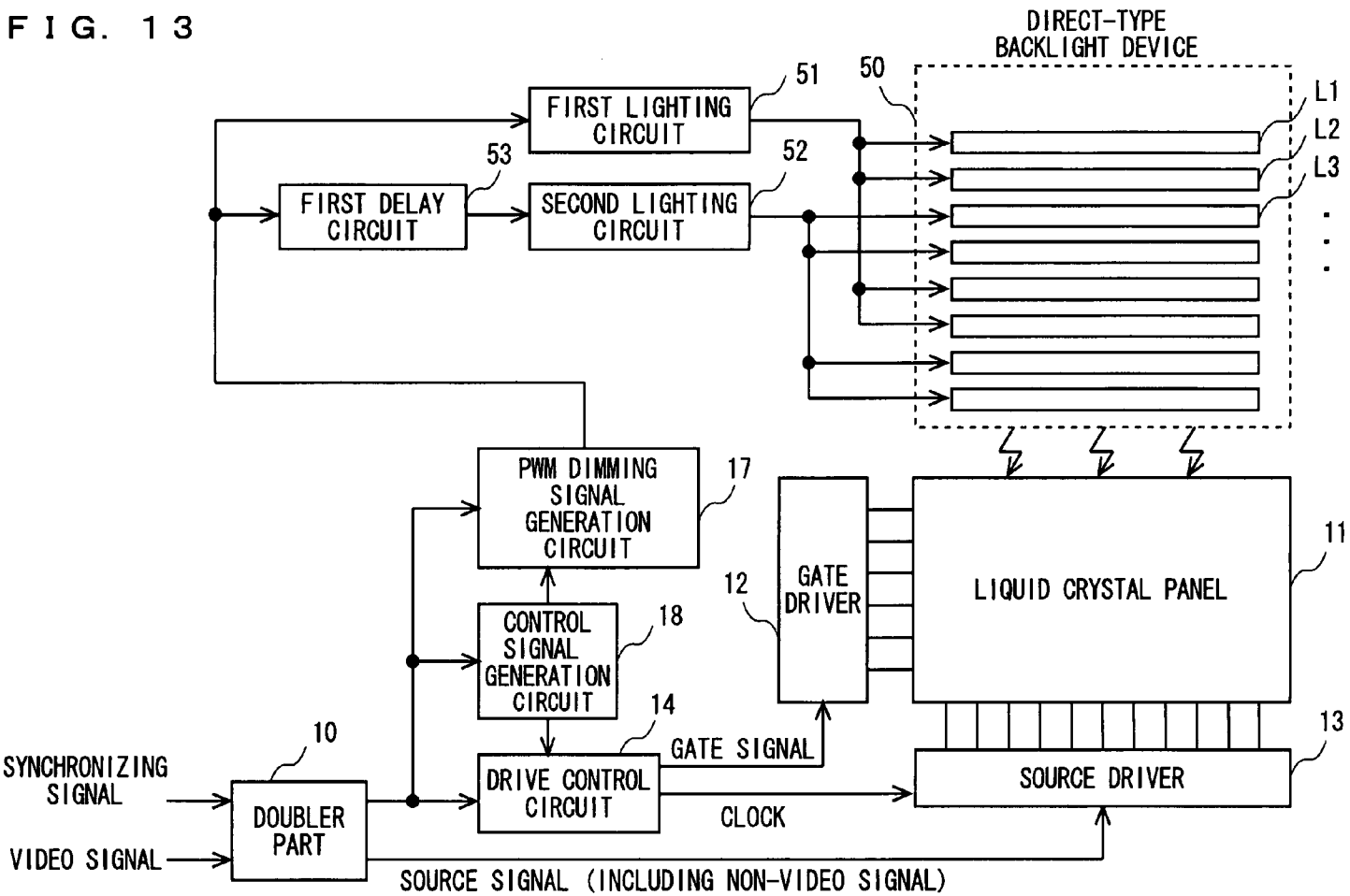
FIG. 13 is a block diagram showing the configuration of a liquid crystal display device according to Embodiment 5 of the present invention.

FIG. 13 is a block diagram showing the configuration of a liquid crystal display device according to Embodiment 5 of the present invention. The liquid crystal display device includes a liquid crystal panel 11, a gate driver 12, a source driver 13, a drive control circuit 14, a PWM dimming signal generation circuit 17, a control signal generation circuit 18, a direct-type backlight device 50, a first delay circuit 53, a first lighting circuit 51, and a second lighting circuit 52. The direct-type backlight device 50 includes a plurality of fluorescent lamps L1 to L8. In FIG. 13, the elements corresponding to those found in FIG. 1 are designated by like reference numerals and the descriptions thereof are omitted.

The PWM dimming signal generation circuit 17 generates a first PWM dimming signal. The first delay circuit 53 receives this first PWM dimming signal and generates a second PWM dimming signal such that the PWM dimming phase of the first PWM dimming signal is shifted by approximately 180°. The first and second PWM dimming signals are provided to the first lighting circuit 51 and the second lighting circuit 52, respectively. Meanwhile, fluorescent lamps of an order i, which satisfies the relationship $(2n-2)M+1 \leqq i \leqq (2n-1)M$, are all activated with dimming, by the first lighting circuit 51 in response to the first PWM dimming signal, and fluorescent lamps of an order j, which satisfies the relationship $(2n-1)M+1 \leqq j \leqq 2nM$, are all activated with dimming, by the second lighting circuit 52 in response to the second PWM dimming signal, wherein i and j (i, j=1, 2, 3, . . . ) are natural numbers that represent the order of the fluorescent lamps starting from one end of the backlight in the direct-type backlight device 50, n (n=1, 2, 3, . . . ) is an arbitrary natural number, and M (M=1, 2, 3, . . . ) is an arbitrary natural number. With such an arrangement, lights emitted from the fluorescent lamps, which are activated in response to the first and second PWM dimming signals, are easily spatially averaged when projected onto the liquid crystal panel 11. The present embodiment describes the case where n=1, 2 and M=2.

Figure 14:
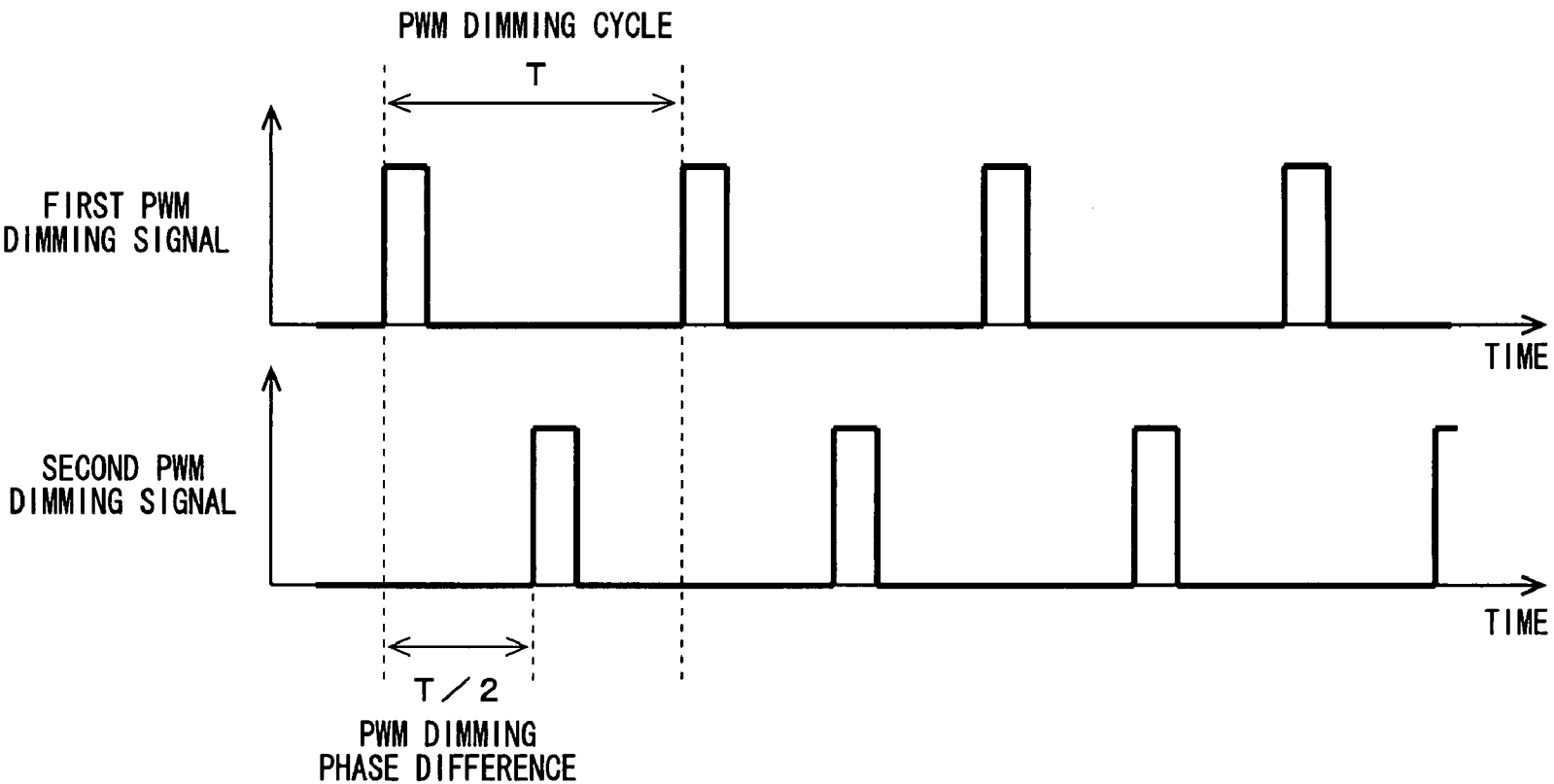
FIG. 14 is a diagram showing the operation of Embodiment 5.

With reference to FIG. 14, the operation of the present embodiment is described in detail below.

In the present embodiment, by two types of PWM dimming signals, as shown in FIG. 14, i.e., the first PWM dimming signal generated by the PWM dimming signal generation circuit 17 and the second PWM dimming signal such that the first PWM dimming signal is delayed by 180° by the first delay circuit 53 comprising, for example, a shift resistor, sets of fluorescent lamps made from the eight fluorescent lamps L1 to L8 (a set consisting of L1, L2, L5, and L6 and a set consisting of L3, L4, L7, and L8) are alternately operated with dimming. Consequently, light emitted from the backlight device 50 is operated as if the PWM dimming frequency were spatial averagely doubled. Accordingly, non-uniformity of luminance and color can be reduced to the same degree as conventional ones, at a PWM dimming frequency which is about half of that conventionally required, and lighting efficiency is improved.

For the liquid crystal panel 11, it is preferable to use either an OCB-mode liquid crystal panel or a TN-mode liquid crystal panel with a cell gap of less than 5 μm (preferably about 2 μm), because in such panels the response time of liquid crystal is fast, and accordingly, edge blurring of a moving image can be further reduced.

In the present embodiment, the phase difference between the first and second PWM dimming signals is set to 180° but, needless to say, even if the phase difference is not exactly 180°, as long as it is close to 180°, substantially the same effects are achieved.

As described above, according to the present embodiment, because lights emitted from the fluorescent lamps L1 to L8, which are activated in response to the first and second PWM dimming signals, are spatially averaged on the liquid crystal panel and the apparent PWM dimming frequency is doubled, colored interference fringes in a liquid crystal display device resulting from the combination of the black insertion drive technique and the PWM dimming technique can be reduced to the same degree as conventional ones, at a PWM dimming frequency which is half of that conventionally required, and lighting efficiency can be improved compared to conventional ones.

(Embodiment 6)

Figure 15:
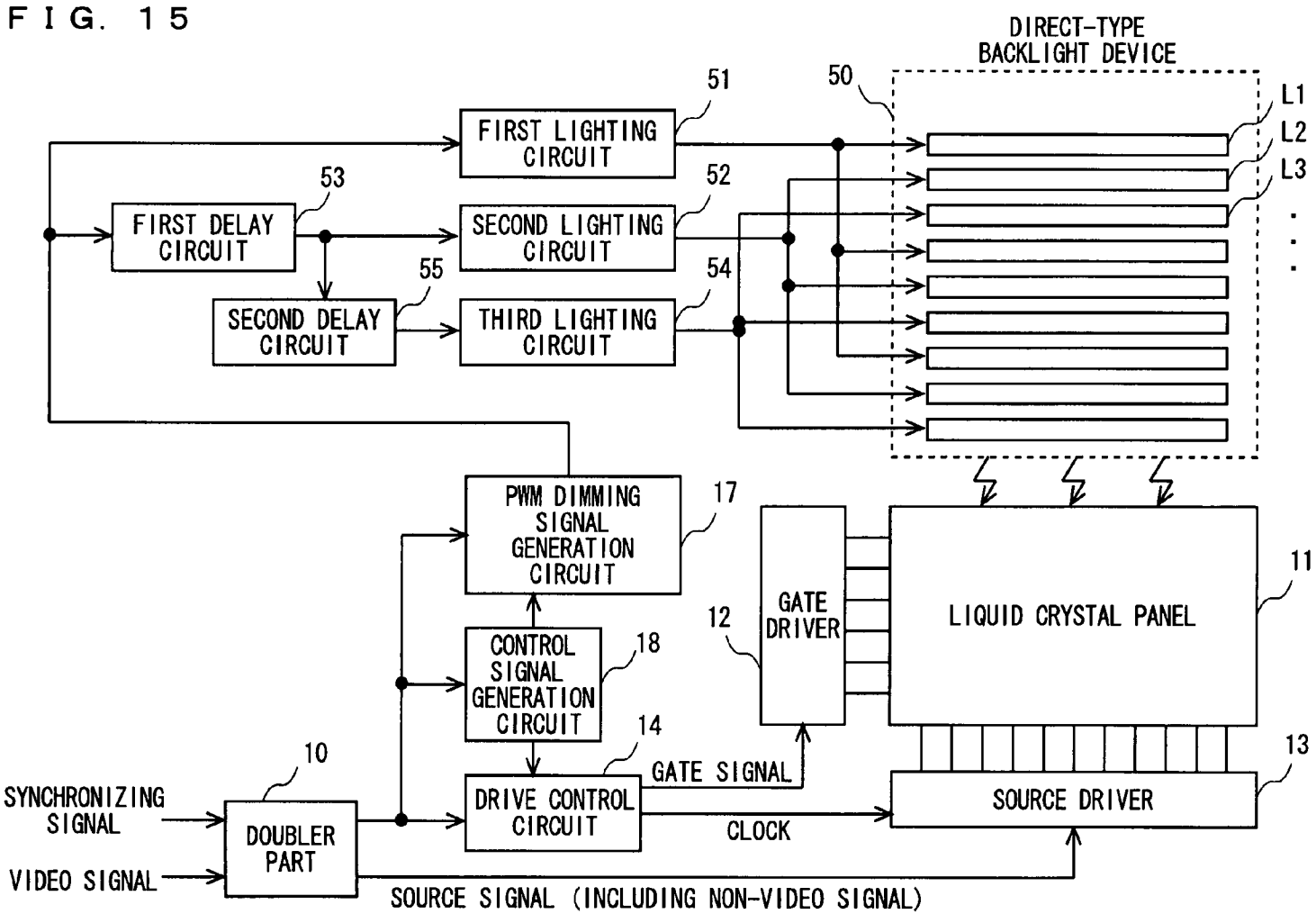
FIG. 15 is a block diagram showing the configuration of a liquid crystal display device according to Embodiment 6 of the present invention.

FIG. 15 is a block diagram showing the configuration of a liquid crystal display device according to Embodiment 6 of the present invention. The liquid crystal display device includes a liquid crystal panel 11, a gate driver 12, a source driver 13, a drive control circuit 14, a PWM dimming signal generation circuit 17, a control signal generation circuit 18, a direct-type backlight device 50, a first delay circuit 53, a second delay circuit 55, a first lighting circuit 51, a second lighting circuit 52, and a third lighting circuit 54. The direct-type backlight device 50 includes a plurality of fluorescent lamps L1 to L9. In FIG. 15, the elements corresponding to those found in FIG. 13 are designated by like reference numerals and the descriptions thereof are omitted.

The PWM dimming signal generation circuit 17 generates a first PWM dimming signal. The first delay circuit 53 receives this first PWM dimming signal and generates a second PWM dimming signal such that the PWM dimming phase of the first PWM dimming signal is delayed by about 120°, and the second delay circuit 55 receives this second PWM dimming signal and generates a third PWM dimming signal such that the phase of the second PWM dimming signal is delayed by about 120°. The first, second, and third PWM dimming signals are provided to the first, second, and third lighting circuits 51, 52, and 54, respectively. Meanwhile, fluorescent lamps of an order i', which satisfies the relationship $(3n'-3)M'+1 \leqq i' \leqq (3n'-2)M'$, are all activated with dimming, by the first lighting circuit 51 in response to the first PWM dimming signal, fluorescent lamps of an order j', which satisfies the relationship $(3n'-2)M'+1 \leqq j' \leqq 2(3n'-1)M'$, are all activated with dimming, by the second lighting circuit 52 in response to the second PWM dimming signal, and fluorescent lamps of an order k', which satisfies the relationship $(3n'-1)M'+1 \leqq k' \leqq 3n'M'$, are all activated with dimming, by the third lighting circuit 54 in response to the third PWM dimming signal, wherein i', j', and k' (i', j', k'=1, 2, 3, . . . ) are natural numbers that represent the order of the fluorescent lamps starting from one end of the backlight of the direct-type backlight device, n' (n'=1, 2, 3, . . . ) is an arbitrary natural number, and M' (M'=1, 2, 3, . . . ) is an arbitrary natural number. With such an arrangement, lights emitted from the fluorescent lamps, which are activated in response to the first, second, and third PWM dimming signals, are easily spatially averaged when projected onto the liquid crystal panel 11. The present embodiment describes the case where n'=1, 2, 3 and M'=1.

Figure 16:
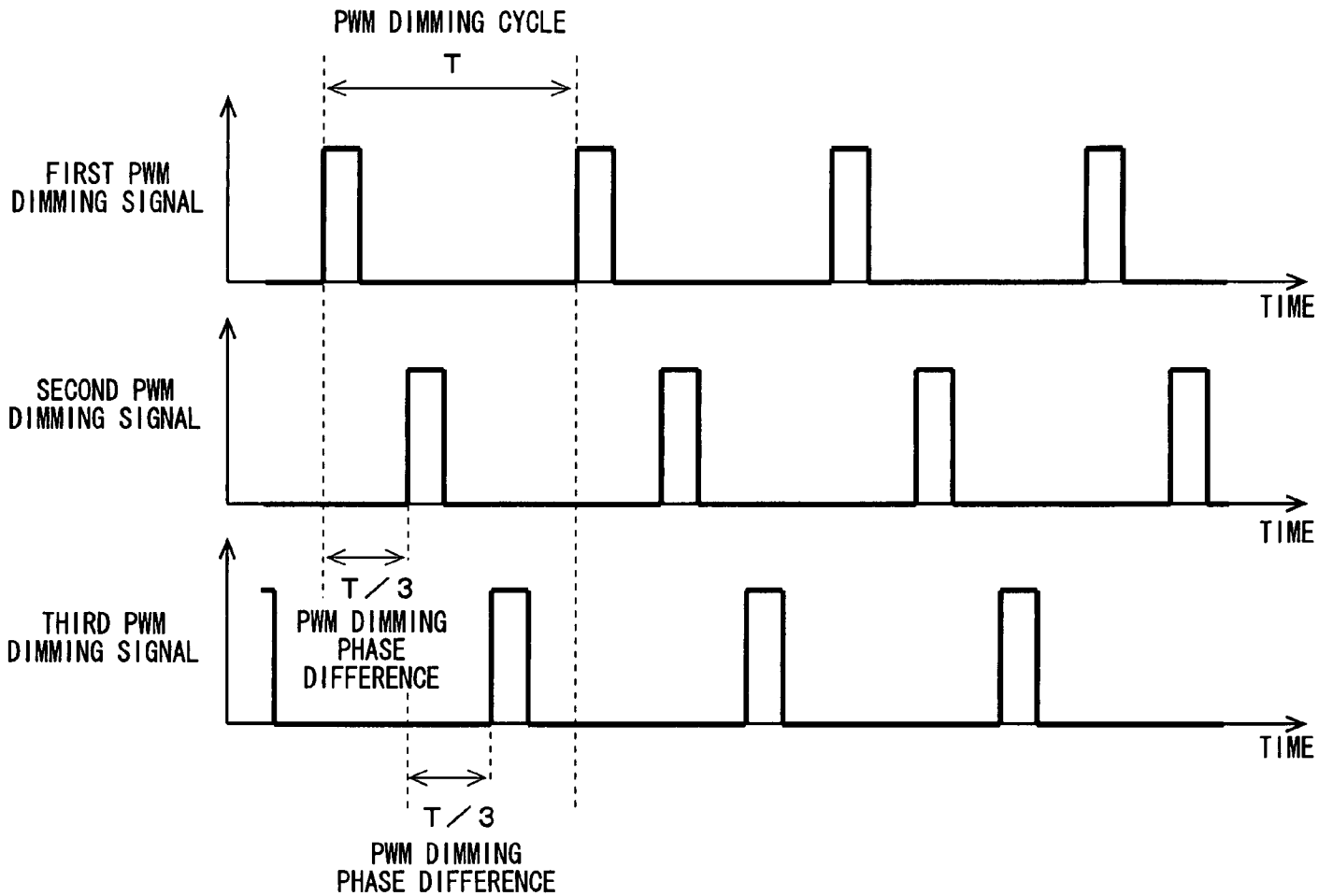
FIG. 16 is a diagram showing the operation of Embodiment 6.
Figure 17:
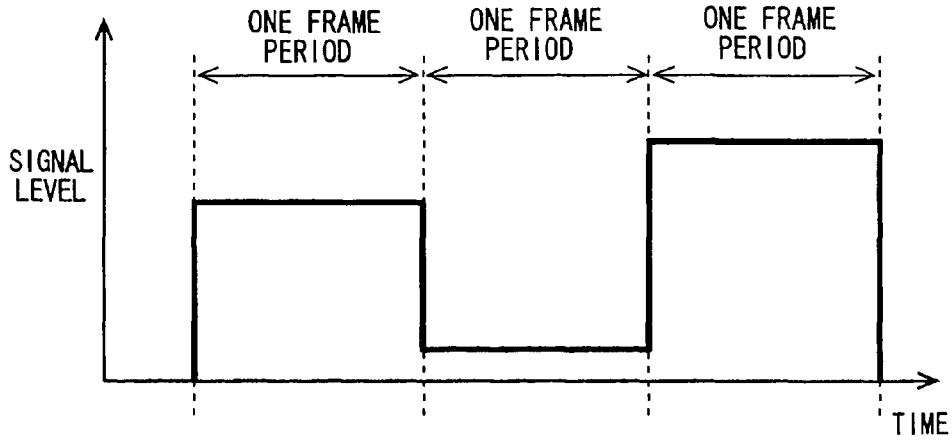
FIG. 17 PRIOR ART
FIG. 17 is an illustrative diagram showing a display signal in a conventional liquid crystal display device.
Figure 18:
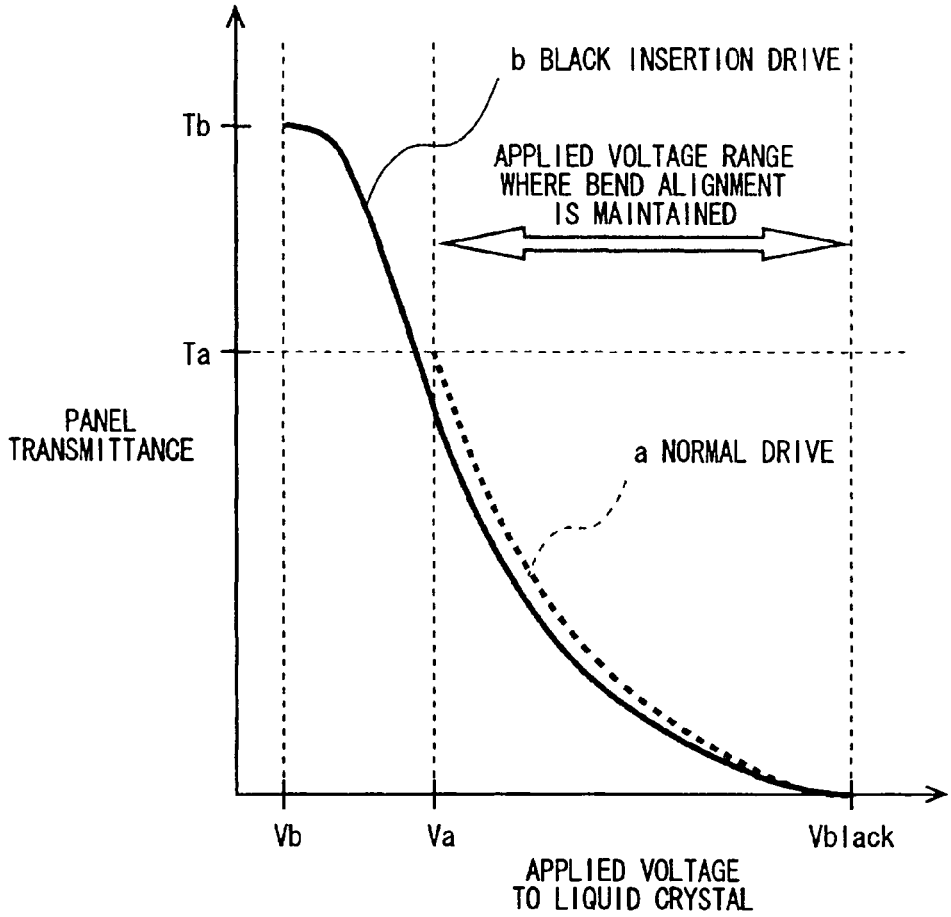
FIG. 18 PRIOR ART
FIG. 18 is an illustrative diagram showing a black insertion drive technique in an OCB-mode liquid crystal.
Figure 19:
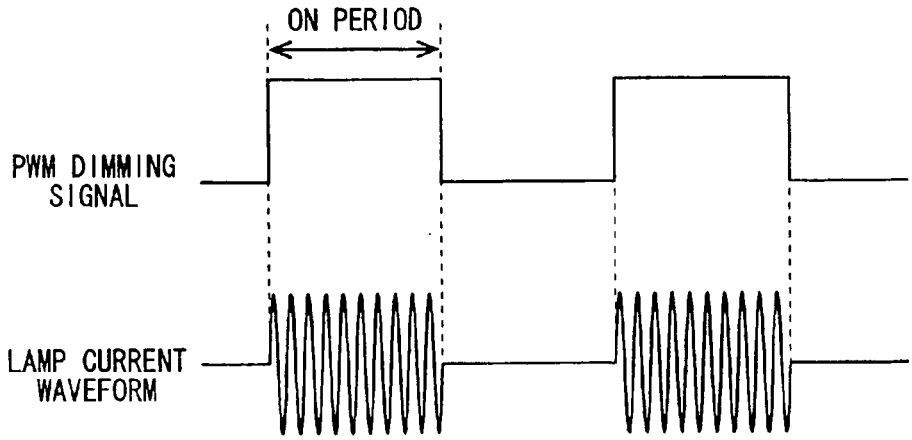
FIG. 19 PRIOR ART
FIG. 19 is an illustrative diagram showing a PWM dimming technique in a backlight.
Figure 20:
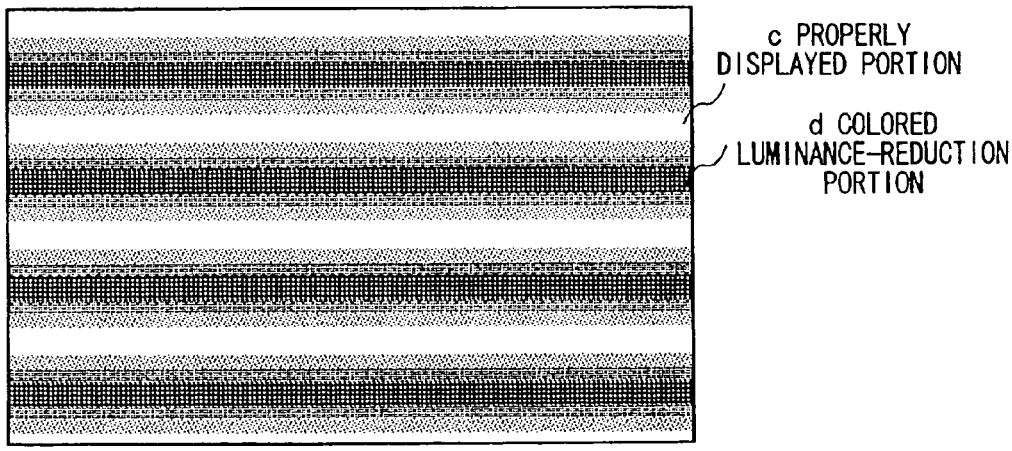
FIG. 20 PRIOR ART
FIG. 20 is an illustrative diagram showing color non-uniformity resulting from the combination of the black insertion drive technique and the PWM dimming technique.
Figure 21:
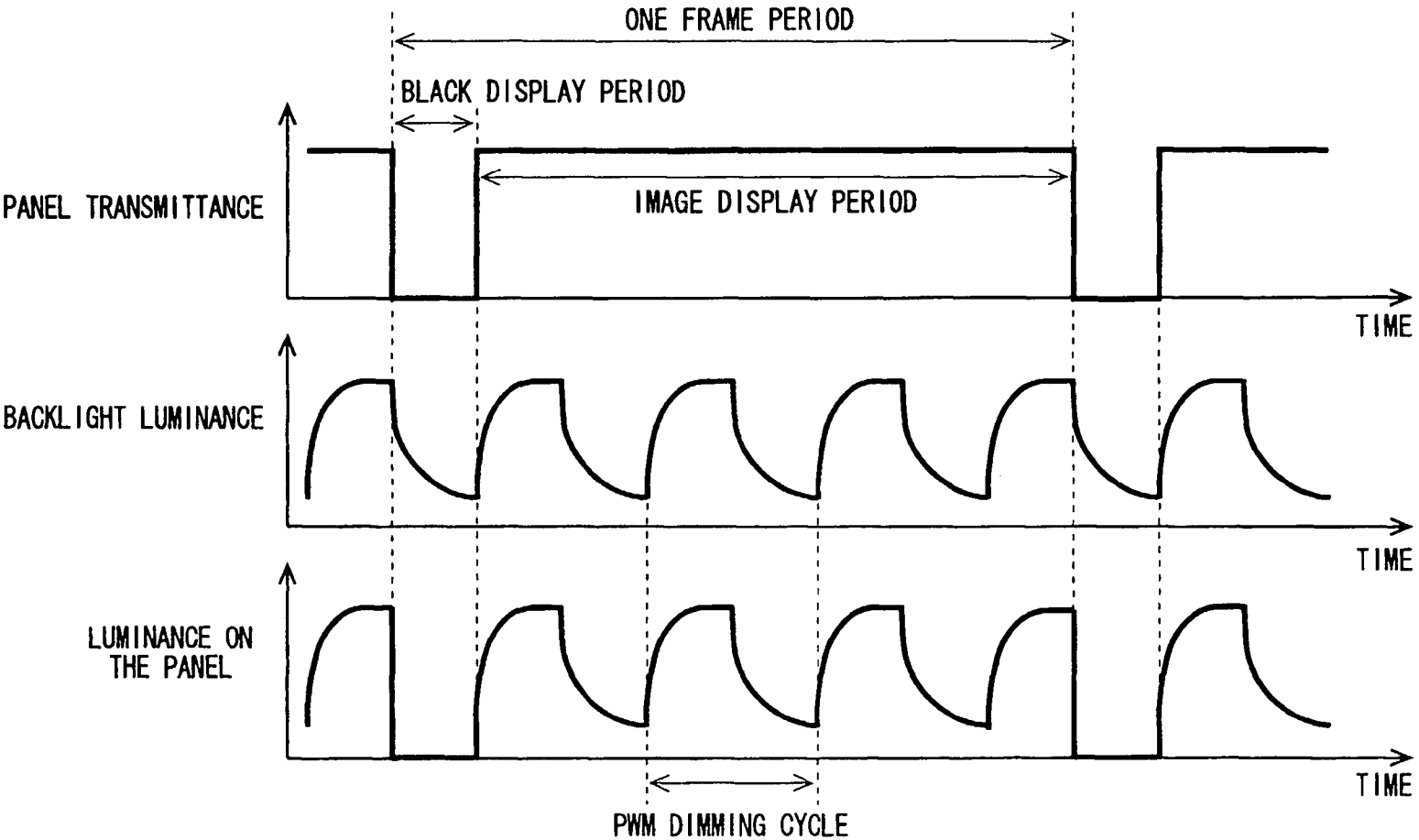
FIG. 21 PRIOR ART
FIG. 21 is a diagram showing the operation in a properly displayed portion in a conventional liquid crystal display device.
Figure 22:
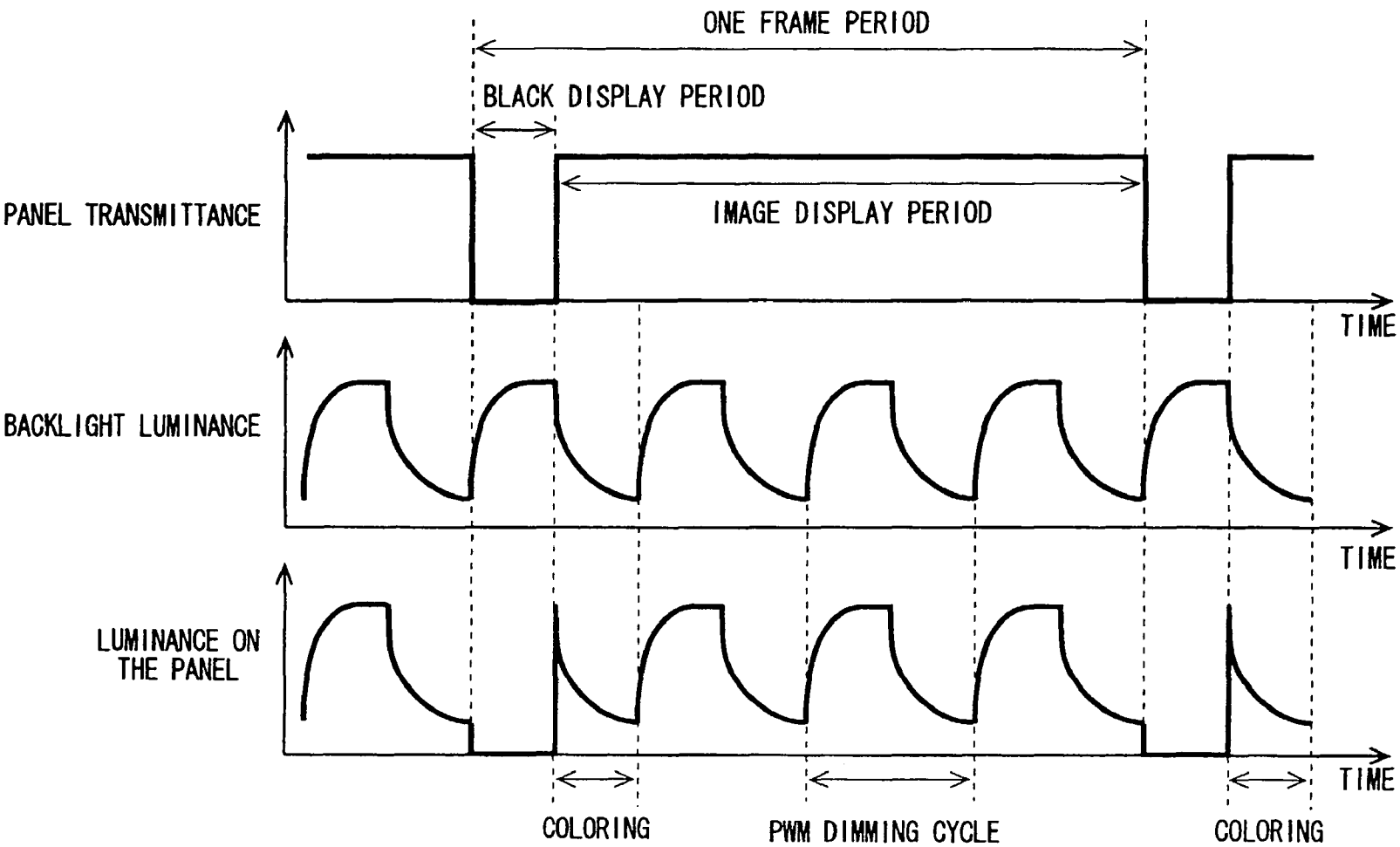
FIG. 22 PRIOR ART
FIG. 22 is a diagram showing the operation in a colored luminance-reduction portion in the conventional liquid crystal display device.

With reference to FIG. 16, the operation of the present embodiment is described in detail below.

In the present embodiment, by three types of PWM dimming signals, as shown in FIG. 16, i.e., the first PWM dimming signal generated by the PWM dimming signal generation circuit 17, the second PWM dimming signal such that the first PWM dimming signal is delayed by 120° by the first delay circuit 51 comprising, for example, a shift resistor, and the third PWM dimming signal such that the second PWM dimming signal is delayed by 120° by the second delay circuit 55, sets of fluorescent lamps made from the nine fluorescent lamps L1 to L9 (a set consisting of L1, L4, and L7, a set consisting of L2, L5, and L8, and a set consisting of L3, L6, and L9) are sequentially operated with dimming. Consequently, light emitted from the backlight device 50 is operated as if the PWM dimming frequency were spatial averagely tripled. Accordingly, non-uniformity of luminance and color can be reduced to the same degree as conventional ones, at a PWM dimming frequency which is about one-third of that conventionally required, and lighting efficiency is improved.

For the liquid crystal panel 11, it is preferable to use either an OCB-mode liquid crystal panel or a TN-mode liquid crystal panel with a cell gap of less than 5 μm (preferably about 2 μm), because in such panels the response time of liquid crystal is fast, and accordingly, edge blurring of a moving image can be further reduced.

In the present embodiment, the PWM dimming phases of the first and second PWM dimming signals are set to be shifted by 120° relative to each other and the PWM dimming phases of the second and third PWM dimming signals are set to be shifted by 120° relative to each other but, needless to say, even if the phase difference is not exactly 120°, as long as is close to 120°, substantially the same effects are achieved.

As described above, according to the present embodiment, because lights emitted from the fluorescent lamps L1 to L9, which are activated in response to the first, second, and third PWM dimming signals, are spatially averaged on the liquid crystal panel and the apparent PWM dimming frequency is tripled, colored interference fringes in a liquid crystal display device resulting from the combination of the black insertion drive technique and the PWM dimming technique can be reduced to the same degree as conventional ones, at a PWM dimming frequency which is one-third of that conventionally required, and lighting efficiency can be improved compared to conventional ones.

INDUSTRIAL APPLICABILITY

As has been described above, according to the present invention, colored interference fringes in a liquid crystal display device resulting from the combination of the black insertion drive technique and the PWM dimming technique can be reduced, making it possible to display higher-quality images.

The invention claimed is:

1. A liquid crystal display device for displaying images by irradiating a liquid crystal panel, which is driven in response to video signals, with light outputted from a backlight device, the liquid crystal display device comprising:

drive means for driving the liquid crystal panel in response to the video signals such that one frame period is divided into a black display period and an image display period;

a PWM dimming signal generation circuit for generating a PWM dimming signal for controlling the backlight device by a PWM dimming technique;

a lighting circuit for driving the backlight device in response to the PWM dimming signal; and means for controlling a cycle and/or phase of the PWM dimming signal to prevent an occurrence of interference fringes in the liquid crystal panel, caused by the PWM dimming technique, wherein a PWM dimming frequency f (Hz) in the PWM technique and a ratio B (%) of the black display period to one frame period satisfy the relationship $f \geqq 25B+250$.

2. The liquid crystal display device according to claim 1, wherein the drive means is operable to control the PWM dimming signal generation circuit such that the PWM dimming frequency f (Hz) and the ratio B (%) satisfy the relationship $f \geqq 25B+250$.

3. A liquid crystal display device for displaying images by irradiating a liquid crystal panel, which is driven in response to video signals, with light outputted from a backlight device, the liquid crystal display device comprising:

drive means for driving the liquid crystal panel in response to the video signals such that one frame period is divided into a black display period and an image display period;

a PWM dimming signal generation circuit for generating a PWM dimming signal for controlling the backlight device by a PWM dimming technique;

a lighting circuit for driving the backlight device in response to the PWM dimming signal; and means for controlling a cycle and/or phase of the PWM dimming signal to prevent an occurrence of interference fringes in the liquid crystal panel, caused by the PWM dimming technique, wherein:

the backlight device is a direct-type backlight device having a structure in which a plurality of light sources are arranged in parallel and directly behind the liquid crystal panel; and the PWM dimming signal generation circuit is operable to dim all light sources of an order i in response to a first PWM dimming signal and dim all light sources of an order j in response to a second PWM dimming signal, the order i satisfying the relationship $(2n-2)M+1 \leqq i \leqq (2n-1)M$ and the order j satisfying the relationship $(2n-1)M+1 \leqq j \leqq 2nM$, wherein i and j (i, j=1, 2, 3, . . .) are natural numbers that represent the order of the light sources from one end of the backlight device, n (n=1, 2, 3, . . .) is an arbitrary natural number, and M (M=1, 2, 3, . . .) is an arbitrary natural number, the first and second PWM dimming signals being similar signals having phases that are shifted by about (PWM dimming cycle/2) relative to each other.

4. The liquid crystal display device according to claim 3, further comprising a delay circuit for controlling the first and second PWM dimming signals such that the phases of the first and second PWM dimming signals are shifted by about (PWM dimming cycle/2) relative to each other.

5. The liquid crystal display device according to claim 3, further comprising a control signal generation circuit for controlling the PWM dimming signal generation circuit such that the first and second PWM dimming signals synchronize to a synchronizing signal of an image.

6. The liquid crystal display device according to claim 3, wherein the natural number M satisfies the relationship M=1.

7. The liquid crystal display device according to claim 3, wherein the light sources arranged directly behind the liquid crystal panel are fluorescent lamps.

8. A liquid crystal display device for displaying images by irradiating a liquid crystal panel, which is driven in response to video signals, with light outputted from a backlight device, the liquid crystal display device comprising:

drive means for driving the liquid crystal panel in response to the video signals such that one frame period is divided into a black display period and an image display period;

a PWM dimming signal generation circuit for generating a PWM dimming signal for controlling the backlight device by a PWM dimming technique;

a lighting circuit for driving the backlight device in response to the PWM dimming signal; and means for controlling a cycle and/or phase of the PWM dimming signal to prevent an occurrence of interference fringes in the liquid crystal panel, caused by the PWM dimming technique, wherein:

the backlight device is a direct-type backlight device having a structure in which a plurality of light sources are arranged in parallel and directly behind the liquid crystal panel; and the PWM dimming signal generation circuit is operable to dim all light sources of an order i' in response to a first PWM dimming signal, dim all light sources of an order j' in response to a second PWM dimming signal, and dim all light sources of an order k' in response to a third PWM dimming signal, the order i' satisfying the relationship $(3n'-3)M'+1 \leqq i' \leqq (3n'-2)M'$, the order j' satisfying the relationship $(3n'-2)M'+1 \leqq J' \leqq 2(3n'-1)M'$, and the order k' satisfying the relationship $(3n'-1)M'+1 \leqq k' \leqq 3n'M'$, wherein i', j', and k'(i', j', k'=1, 2, 3, . . .) are natural numbers that represent the order of the light sources from one end of the backlight device, n'(n'+1, 2, 3, . . .) is an arbitrary natural number, and M'(M'=1, 2, 3,...) is an arbitrary natural number, the first, second, and third PWM dimming signals being similar signals in which phases of the first and second PWM dimming signals are shifted by about (PWM dimming cycle/3) relative to each other and the phase of the second PWM dimming signal and a phase of the third PWM dimming signal are shifted by about (PWM dimming cycle/3) relative to each other.

9. The liquid crystal display device according to claim 8, further comprising a delay circuit for controlling the first, second, and third PWM dimming signals such that the phases of the first and second PWM dimming signals are shifted by about (PWM dimming cycle/3) relative to each other and the phases of the second and third PWM dimming signals are shifted by about (PWM dimming cycle/3) relative to each other.

10. The liquid crystal display device according to claim 8, further comprising a control signal generation circuit for controlling the PWM dimming signal generation circuit such that the first, second, and third PWM dimming signals synchronize to a synchronizing signal of an image.

11. The liquid crystal display device according to claim 8, wherein the natural number M' is 1.

12. The liquid crystal display device according to claim 8, wherein the light sources arranged directly behind the liquid crystal panel are fluorescent lamps.

* * * * *